US010832642B2

(12) United States Patent
Sikra

(10) Patent No.: US 10,832,642 B2
(45) Date of Patent: Nov. 10, 2020

(54) DRUM PEDAL WITH FEATURES FOR ADJUSTMENT OF CHAIN OR SIMILAR DEVICE

(71) Applicant: DRUM WORKSHOP, INC., Oxnard, CA (US)

(72) Inventor: Richard A. Sikra, Thousand Oaks, CA (US)

( * ) Notice: Subject to any disclaimer, the term of this patent is extended or adjusted under 35 U.S.C. 154(b) by 124 days.

(21) Appl. No.: 15/409,408

(22) Filed: Jan. 18, 2017

(65) Prior Publication Data

US 2017/0124993 A1 May 4, 2017

Related U.S. Application Data

(63) Continuation-in-part of application No. 14/495,718, filed on Sep. 24, 2014, now Pat. No. 9,589,546, and a continuation-in-part of application No. 15/002,264, filed on Jan. 20, 2016, now Pat. No. 9,640,154.

(60) Provisional application No. 61/882,538, filed on Sep. 25, 2013, provisional application No. 61/899,762, filed on Nov. 4, 2013, provisional application No. 62/106,144, filed on Jan. 21, 2015, provisional application No. 62/106,661, filed on Jan. 22, 2015, provisional application No. 62/280,998, filed on Jan. 20, 2016.

(51) Int. Cl.
*G10D 13/11* (2020.01)

(52) U.S. Cl.
CPC ..... *G10D 13/11* (2020.02)

(58) Field of Classification Search
USPC ..... 84/422.1
See application file for complete search history.

(56) References Cited

U.S. PATENT DOCUMENTS

| | | | | |
|---|---|---|---|---|
| 1,042,904 | A | 10/1912 | Fraser | |
| 1,042,919 | A | 10/1912 | Hughes | 84/422.2 |
| 2,132,211 | A | 10/1938 | Walter | |
| 3,147,661 | A | 9/1964 | Padera | |
| 3,530,757 | A | 9/1970 | Osuga | |
| 3,797,356 | A | 3/1974 | Duffy et al. | |
| 4,145,951 | A | 3/1979 | Kobayashi | |
| 4,198,894 | A | 4/1980 | Della-Porta | |
| 4,200,025 | A | 4/1980 | Currier | |
| 4,449,440 | A | 5/1984 | Hoshino | |
| 4,488,471 | A | 12/1984 | Youakim | |
| 4,517,876 | A | 5/1985 | Duhon | |
| 4,667,562 | A | 5/1987 | Lee | |

(Continued)

OTHER PUBLICATIONS

Office Action for U.S. Appl. No. 15/583,173; dated Mar. 16, 2018.

(Continued)

*Primary Examiner* — Christopher Uhlir
(74) *Attorney, Agent, or Firm* — Ferguson Case Orr Paterson

(57) ABSTRACT

Drum pedal assemblies are disclosed which can include one or more adjustment features. Adjustment features which can be included in embodiments of the invention can include spring tension adjustment features, pedal incline adjustment features, lever length adjustment features, beater stem angle adjustment features, chain path adjustment features, operable chain length adjustment features, and chain connection point position adjustment features.

39 Claims, 15 Drawing Sheets

(56) References Cited

U.S. PATENT DOCUMENTS

| | | | | |
|---|---|---|---|---|
| 4,756,224 | A | 7/1988 | Lombardi | 84/422.1 |
| 4,846,040 | A | 7/1989 | Hoshino | |
| 4,945,802 | A * | 8/1990 | Ruprecht | G10D 13/006 84/225 |
| 4,976,181 | A | 12/1990 | Hsieh | |
| 4,977,810 | A | 12/1990 | Hsieh | |
| 5,090,289 | A | 2/1992 | Holcomb | |
| 5,251,528 | A | 10/1993 | Kurosaki | |
| 5,297,467 | A * | 3/1994 | Hoshino | G10D 13/006 84/422.1 |
| 5,301,592 | A | 4/1994 | Johnston | |
| 5,388,494 | A * | 2/1995 | Hoshino | G10D 13/006 84/422.1 |
| 5,557,054 | A | 9/1996 | Shigenaga | 84/422.1 |
| 5,646,360 | A | 7/1997 | Liao | 84/422.1 |
| 5,789,688 | A | 8/1998 | Schiano | |
| 5,945,616 | A | 8/1999 | Hoshino | |
| 6,003,822 | A | 12/1999 | Kurosaki | |
| 6,031,170 | A | 2/2000 | Hoshino | |
| 6,166,312 | A | 12/2000 | Brewster | |
| 6,271,450 | B1 | 8/2001 | Mackie | |
| 6,278,046 | B1 | 8/2001 | Sikra | |
| 6,329,584 | B1 | 12/2001 | Liao | |
| 6,359,205 | B1 | 3/2002 | Lombardi | 84/422.1 |
| 6,399,865 | B1 | 6/2002 | Ishimatsu | |
| 6,570,076 | B1 | 5/2003 | Kjellgren | 84/422.1 |
| 6,573,443 | B1 | 6/2003 | Chen | 84/422.1 |
| 6,590,147 | B2 | 7/2003 | Kassabian | 84/422.1 |
| 6,689,945 | B1 | 2/2004 | Matsuzoe | 84/422.1 |
| 6,747,200 | B2 | 6/2004 | Sato | |
| 6,762,354 | B2 | 7/2004 | Cocca | |
| 6,822,149 | B1 | 11/2004 | Liao | |
| 6,894,210 | B1 * | 5/2005 | Lombardi | G10D 13/006 84/422.1 |
| 6,903,257 | B2 | 6/2005 | Yun | 84/422.1 |
| 6,906,252 | B2 | 6/2005 | Matsuzoe | 84/422.1 |
| 6,930,232 | B2 | 8/2005 | Shigenaga | |
| 7,071,400 | B1 | 7/2006 | Lombardi | 84/402 |
| 7,197,957 | B2 | 4/2007 | Gatzen | 74/560 |
| 7,301,088 | B2 | 11/2007 | Chen | |
| 7,371,953 | B2 | 5/2008 | Takegawa | |
| 7,399,916 | B1 | 7/2008 | Lombardi | 84/422.1 |
| 7,405,352 | B2 | 7/2008 | Dorfman | |
| 7,449,626 | B2 | 11/2008 | Chen | 84/422.1 |
| 7,456,351 | B2 | 11/2008 | Dorfman | 84/422.1 |
| 7,511,212 | B1 | 3/2009 | Chang | |
| 7,579,540 | B2 | 8/2009 | Takegawa | 84/422.1 |
| 7,626,107 | B1 | 12/2009 | Takegawa | 84/422.1 |
| 7,633,000 | B2 | 12/2009 | Dorfman | |
| 7,671,262 | B1 * | 3/2010 | Lin | G10D 13/006 84/422.1 |
| 7,737,352 | B2 | 6/2010 | Chang | |
| 7,928,305 | B1 | 4/2011 | Chen | 84/422.1 |
| 7,956,268 | B1 | 6/2011 | Liao | |
| 7,968,781 | B1 | 6/2011 | Luo | 84/422.1 |
| 7,999,165 | B2 * | 8/2011 | Chen | G10D 13/006 84/422.1 |
| 8,026,434 | B2 * | 9/2011 | Luo | G10D 13/006 84/422.1 |
| 8,063,293 | B1 | 11/2011 | Kjellgren | |
| 8,076,562 | B1 | 12/2011 | Lin | 84/422.1 |
| 8,278,541 | B2 | 10/2012 | Dorfman | 84/422.1 |
| 8,330,032 | B1 | 12/2012 | Sikra | 84/422.1 |
| 8,410,346 | B2 | 4/2013 | Sassmannshausen | 84/422.1 |
| 8,455,746 | B2 | 6/2013 | Johnston et al. | |
| 8,735,705 | B1 | 5/2014 | Chen | |
| 8,859,870 | B2 | 10/2014 | Yamane | |
| 8,946,531 | B2 | 2/2015 | Nakata | |
| 8,993,865 | B2 | 3/2015 | Liao | |
| 9,460,692 | B2 | 10/2016 | Chen | |
| 9,466,272 | B1 | 10/2016 | Lin | |
| 9,472,174 | B2 | 10/2016 | Sikra | |
| 9,589,546 | B2 | 3/2017 | Sikra | |
| 9,640,154 | B2 | 5/2017 | Sikra | |
| 9,928,815 | B2 | 3/2018 | Sikra | |
| 10,152,955 | B2 | 12/2018 | Sikra | |
| 2002/0056357 | A1 | 5/2002 | Kassabian | |
| 2003/0209128 | A1 | 11/2003 | Hsieh | |
| 2004/0060421 | A1 | 4/2004 | Yun | |
| 2005/0150354 | A1 | 7/2005 | Paul | 84/422.1 |
| 2006/0169124 | A1 | 8/2006 | Tanaka | |
| 2007/0044637 | A1 | 3/2007 | Kjellfren | 84/422.1 |
| 2007/0113722 | A1 | 5/2007 | Chen | |
| 2007/0131088 | A1 * | 6/2007 | Hauck | G10D 13/006 84/422.1 |
| 2008/0195574 | A1 | 8/2008 | Kjellgren | 84/422.1 |
| 2008/0245210 | A1 | 10/2008 | Chang | |
| 2011/0067552 | A1 | 3/2011 | Chen | 84/412 |
| 2012/0198984 | A1 | 8/2012 | Johnston | 84/422.1 |
| 2014/0182445 | A1 | 7/2014 | Liao | 84/422.1 |
| 2015/0082968 | A1 | 3/2015 | Sikra | 84/422.1 |
| 2015/0187343 | A1 | 7/2015 | Mori | 84/746 |
| 2016/0063973 | A1 | 3/2016 | Lemieux | |
| 2016/0210946 | A1 | 7/2016 | Sikra | |
| 2017/0124993 | A1 | 5/2017 | Sikra | |
| 2017/0236503 | A1 | 8/2017 | Sikra | |

OTHER PUBLICATIONS

Office Action from U.S. Appl. No. 15/263,881, dated May 19, 2017.
DW Drums, "DW 9000 Pedal Upgrades—Artist Testimonials", Youtube; Video (online), Nov. 5, 2012 (retrieved Mar. 15, 2017). Retrieved from the Internet: https://www.youtube.com/watch?v=B9zKsz93PVk>; 6:0093:13.
International Search Report and Written Opinion from patent appl. No. PCT/US17/13991, dated Apr. 6, 2017.
U.S. Appl. No. 14/506,350, filed Oct. 3, 2014, Sikra.
U.S. Appl. No. 13/663,655, filed Oct. 30, 2012, Sikra
DWCP3500 "Hi-Hat Stand" from Drum Workshop. Inc. available online at www.dwdrums.com. downloaded Feb. 3, 2015.
International Search Report and Written Opinion from Appl. No. PCT/US14/57383. dated Dec. 17, 2014.
Foreign Office Action for Taiwan Patent Application No. 103133197; dated Aug. 16, 2018.
Foreign Office Action for Japanese Application No. 2019-545222; dated Sep. 4, 2018.
Foreign Office Action for Japanese Application No. 2016-54522; dated Mar. 26, 2019.
Foreign Office Action for Taiwan Patent Application No. 103133197; dated Aug. 1, 2019.
Office Action for U.S. Appl. No. 15/936,146; dated Mar. 18, 2019.

* cited by examiner

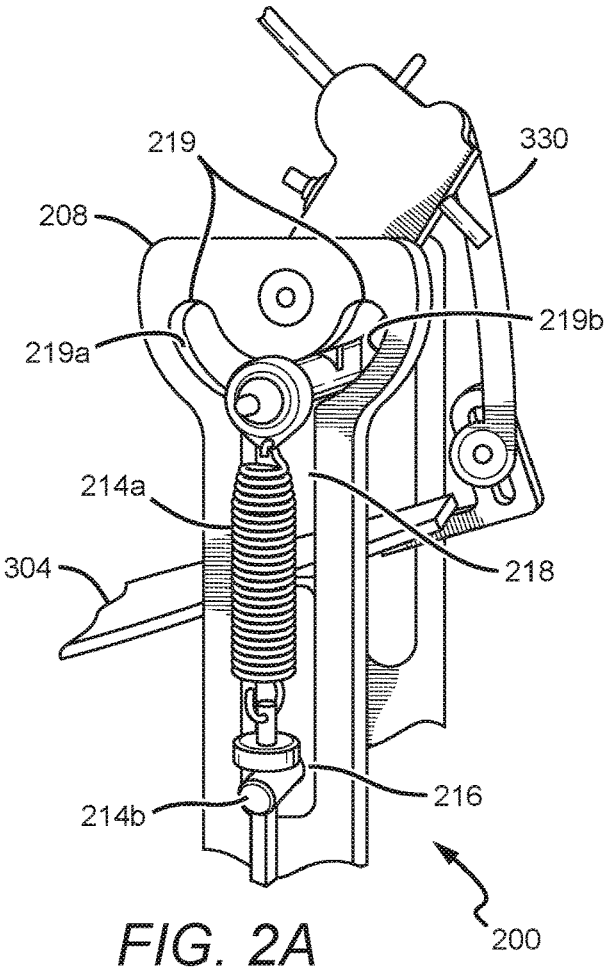
FIG. 2A
FIG. 2B
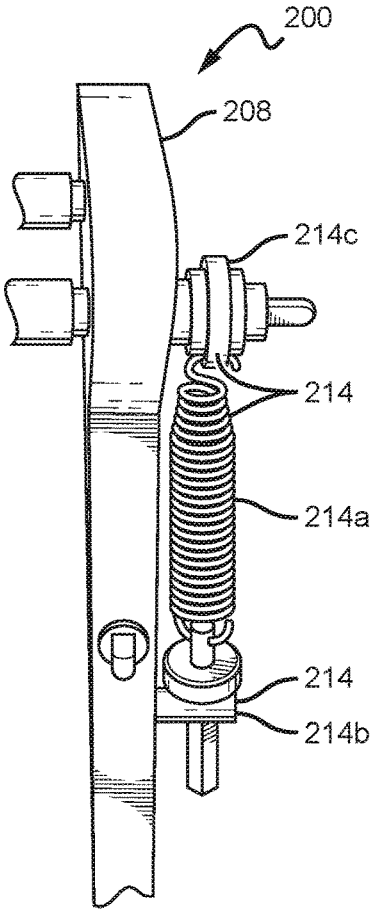
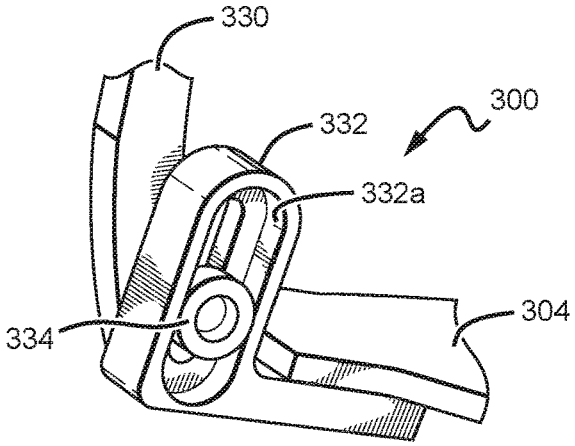
FIG. 3A
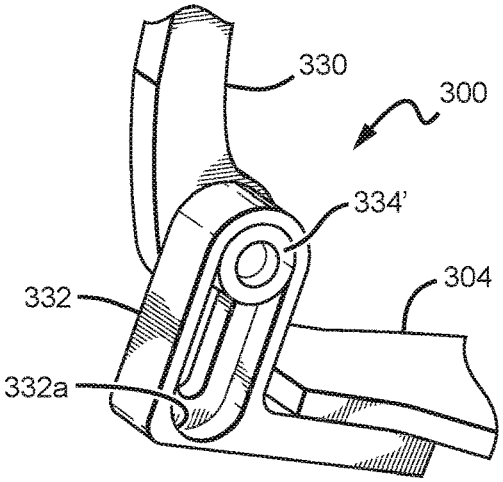
FIG. 3B

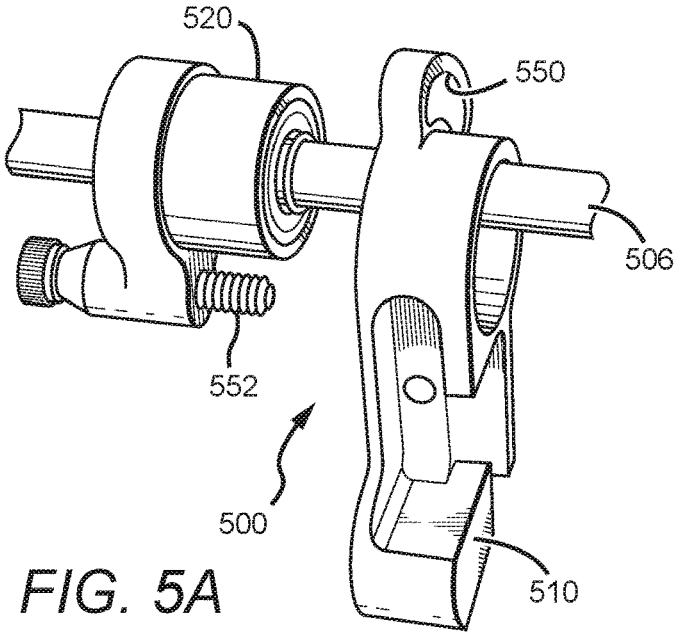
FIG. 5A
FIG. 5B
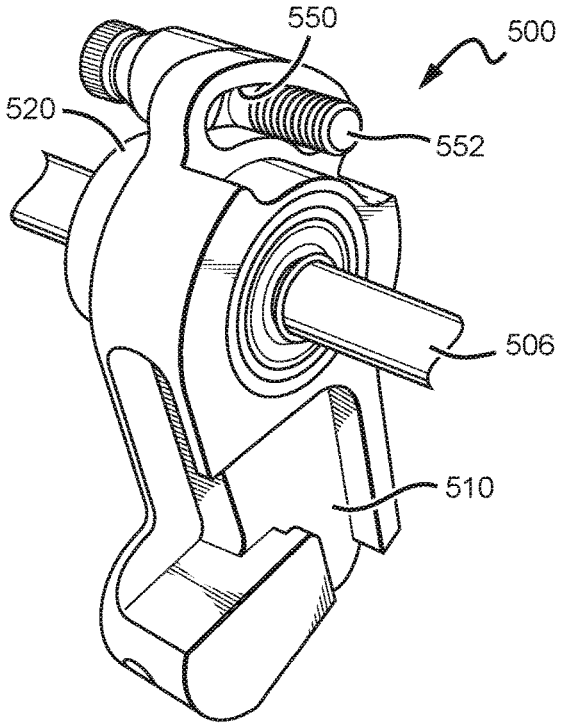
FIG. 5C
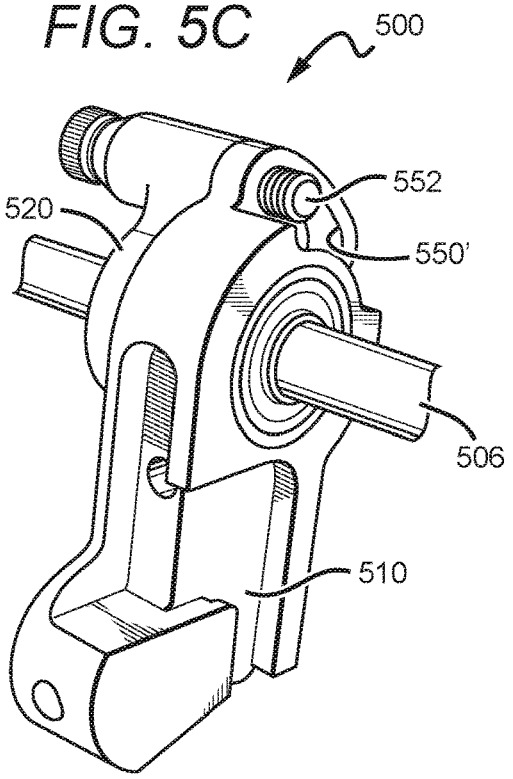

FIG. 7
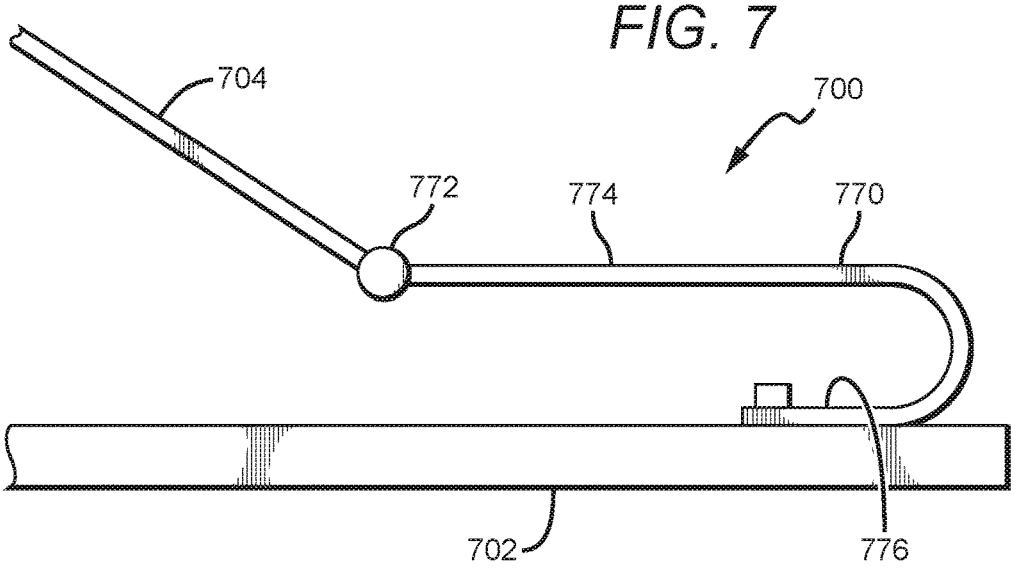
FIG. 8C
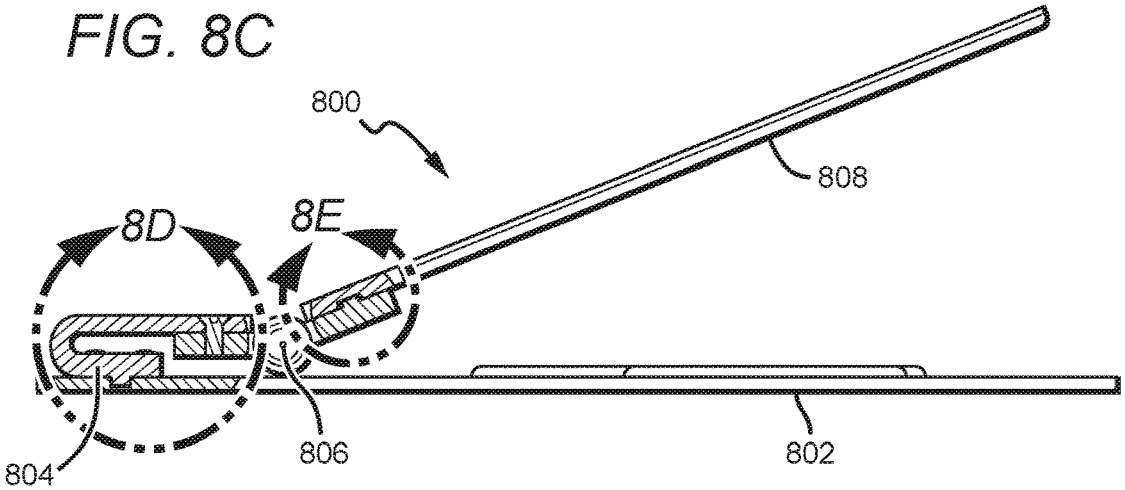
FIG. 8D
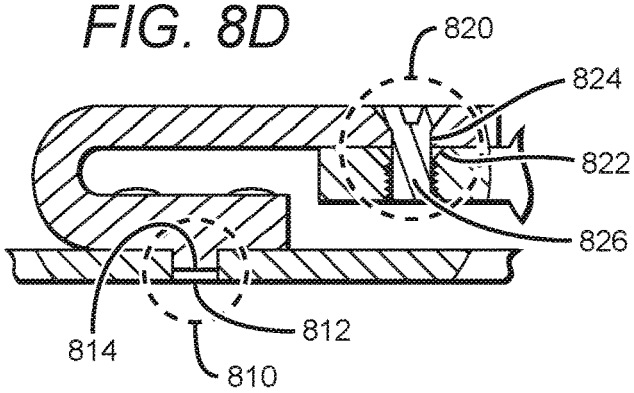
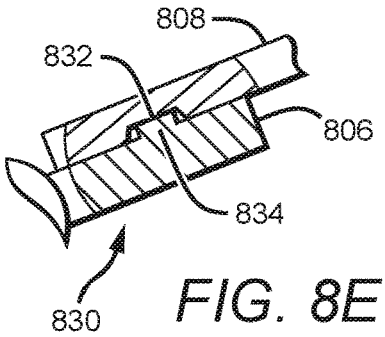
FIG. 8E

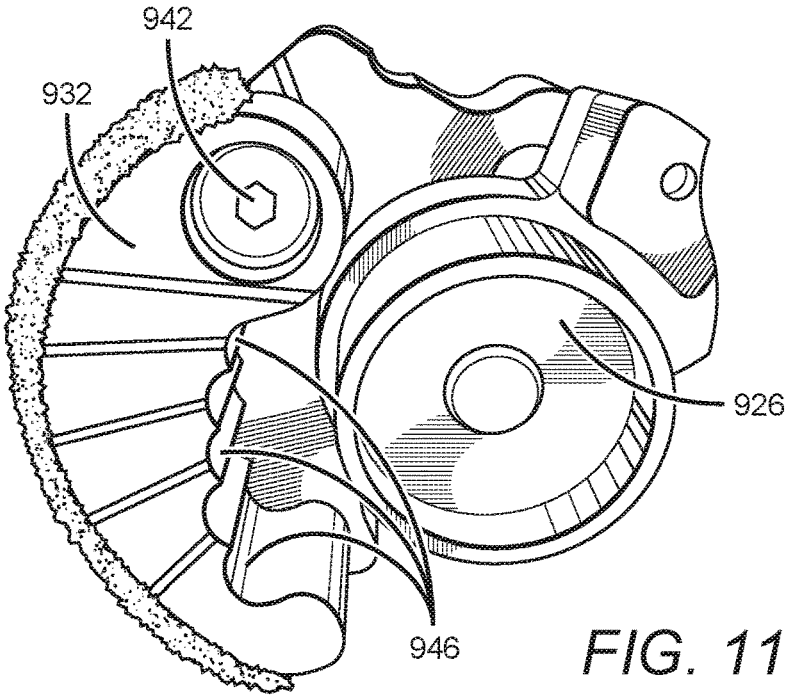
FIG. 11
FIG. 12
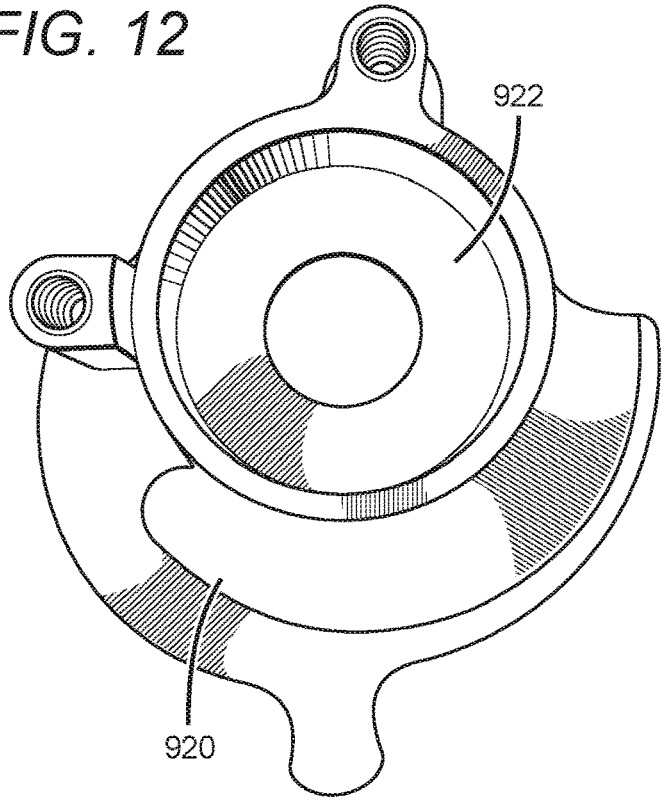

DRUM PEDAL WITH FEATURES FOR ADJUSTMENT OF CHAIN OR SIMILAR DEVICE

This application is a continuation-in-part of U.S. patent application Ser. No. 14/495,718 to Sikra, filed on Sep. 24, 2014 and entitled "Drum Pedal with Adjustment Features," which claims the benefit of U.S. Provisional Patent Application No. 61/882,538 to Sikra, filed on Sep. 25, 2013, and U.S. Provisional Patent Application No. 61/899,762 to Sikra, filed on Nov. 4, 2013; and is a continuation-in-part of U.S. patent application Ser. No. 15/002,264 to Sikra, filed on Jan. 20, 2016 and entitled "Hi-Hat Pedal Assembly," which claims the benefit of U.S. Provisional Patent Application No. 62/106,144 to Sikra, filed on Jan. 21, 2015, and U.S. Provisional Patent Application No. 62/106,661 to Sikra, filed on Jan. 22, 2015. This application also claims the benefit of U.S. Provisional Patent Application No. 62/280,998 to Sikra, filed on Jan. 20, 2016 and entitled "Drum Pedal with Features for Adjustment of Chain or Similar Device." Each of the above applications is fully incorporated by reference herein in its entirety.

BACKGROUND OF THE INVENTION

Field of the Invention

This invention relates generally to drum beating devices connectable to drums, such as bass drums, and more particularly to features such as adjustment features included in such devices.

Description of the Related Art

Drum pedal assemblies are used as a mechanism with which a drummer can strike a drum such as a bass drum, thus allowing the drummer's hands to be free for use with other drums. Variations in drummer technique mean that it is very difficult to design a single pedal to meet the needs of every drummer. Such variables can include drumming speed, foot force, and desired strike point.

Adjustable pedals can provide the customization necessary to achieve some or all of a drummer's desired pedal characteristics. Some pedals with adjustable features are described in U.S. Pat. Nos. 5,301,592 and 8,455,746 to Johnston, and U.S. Pat. No. 6,590,147 to Kassabian, each of which is fully incorporated by reference herein in its entirety. However, adjustment mechanisms provided in the prior art can be unwieldy, which can increase difficulty to the user, and/or can lack adjustability of a variable which is independent of other variables, thus reducing the amount of customization available via adjustments.

Prior art pedals also often use fasteners to connect different parts of a drum pedal assembly. However, due to normal wear and tear, a drum pedal assembly using fasteners such as screws as connection mechanisms can begin to experience unwanted movement during use. For example, a pedal can begin to experience lateral motion, when only upward and downward motion is desired.

SUMMARY OF THE DISCLOSURE

The present disclosure relates to drum pedal assemblies for use with percussion instruments, such as a a bass drum. The pedal assembly can include various adjustable features such that a user can alter the operation of the pedal assembly to fit his or her needs.

One embodiment of a drum beating device according to the present invention can include a drive mechanism on an axle, with a pedal operably connected to the drive mechanism by a link member. The drive mechanism can include a link member adjustment component, with the link member attached to the link member adjustment component at a link member attachment point. The position of the link member attachment point can be adjustable relative to the link member so as to change an operable length of the link member (e.g., the link member attachment point can be at different points along the link member).

One embodiment of a drum beating device according to the present invention can include a drive mechanism on an axle, with a pedal operably connected to the drive mechanism by a link member. The drive mechanism can include an actuating cam with the link member at least partially on the actuating cam, and the resting position of the actuating cam can be adjustable so as to adjust a resting position of the link member.

One embodiment of a drum beating device according to the present invention can include a drive mechanism on an axle, with a pedal connected to the drive mechanism by a link member. The drive mechanism can include a beater holder and a link member adjustment component, with the link member operably connecting the pedal to the link member adjustment component. The resting position of the link member adjustment component can be adjustable relative to a resting position of the beater holder.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further features and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

FIGS. 2A and 2B are side and rear views of a portion of another embodiment of a drum pedal assembly according to the present invention.

FIGS. 3A and 3B are side views of a portion of another embodiment of a drum pedal assembly according to the present invention.

FIGS. 5A-5C are perspective views of a portion of another embodiment of a drum pedal assembly according to the present invention.

FIG. 7 is a side view of a portion of another embodiment of a drum pedal assembly according to the present invention.

FIGS. 8A-8E are perspective, exploded perspective, side, and two magnified side views of another embodiment of a portion of a drum pedal assembly according to the present invention.

FIG. 11 is a side view of a portion of one embodiment of a drive assembly according to the present invention.

FIG. 12 is a side view of a portion of one embodiment of a drive assembly according to the present invention.

DETAILED DESCRIPTION OF THE INVENTION

Figure 1A:
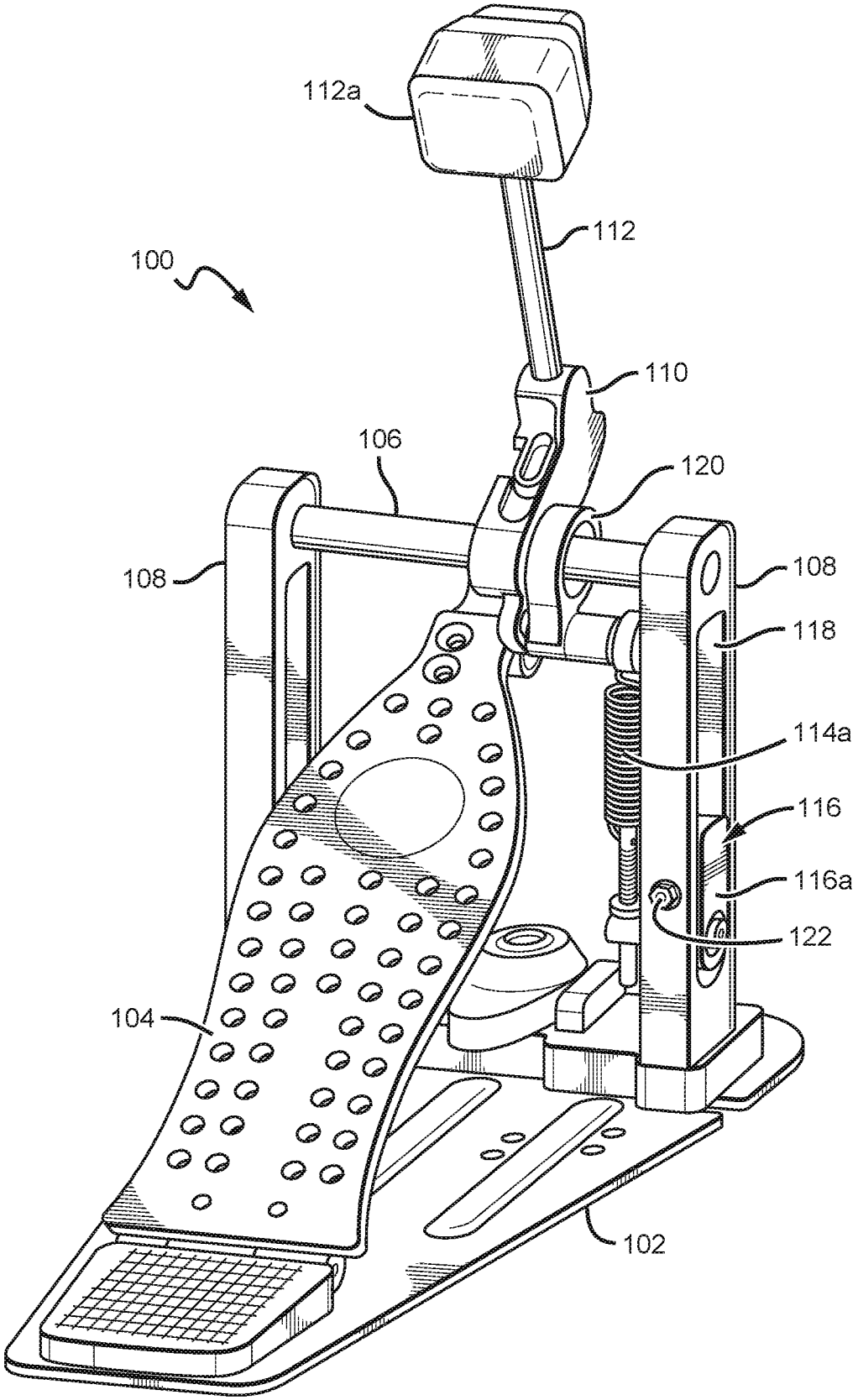
FIGS. 1A and 1B are perspective views of one embodiment of a drum pedal assembly according to the present invention.

The present invention relates to a drum beating device such as a pedal device for use with a bass drum. The drum beating device can include adjustment features to change 1) the tension of a spring within the device, 2) the inclination angle of the pedal, 3) the distance between a beater stem and axle, and/or 4) the angle the lever forms with the axle when in a rest position. The drum beating device can also include a flexible heel plate attached to a base and/or pedal. The drum beating device can also include interconnection features such as tab/slot combinations for connecting two or more parts of the device. These tab/slot combinations can reduce or eliminate undesired movements.

Additionally, drum beating devices according to the present invention can include features for adjusting the operable length of a link member such as a chain, features for adjusting the path which a link member such as a chain takes to the point it attaches to a drive assembly, and/or features for adjusting the position of the point where the link member/chain attaches to the drive assembly relative to the position of the drive assembly beater holder. These features can be particularly adapted to systems utilizing flexible link members such as chains.

It is understood that when an element is referred to as being "on" another element, "connected to" another element, or "attached to" another element, it can be directly on/connected to/attached to the other element or intervening elements may also be present. Further, when one element is referred to as being "connected" to another element, it can be directly connected to the other element or intervening elements may also be present as would be understood by one of skill in the art. Furthermore, relative terms such as "inner", "outer", "upper", "top", "above", "lower", "bottom", "beneath", "below", and similar terms, may be used herein to describe a relationship of one element to another. Terms such as "higher", "lower", "wider", "narrower", and similar terms, may be used herein to describe angular relationships. It is understood that these terms are intended to encompass different orientations of the elements or system in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

Embodiments of the invention are described herein with reference to view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region and are not intended to limit the scope of the invention.

Figure 1B:
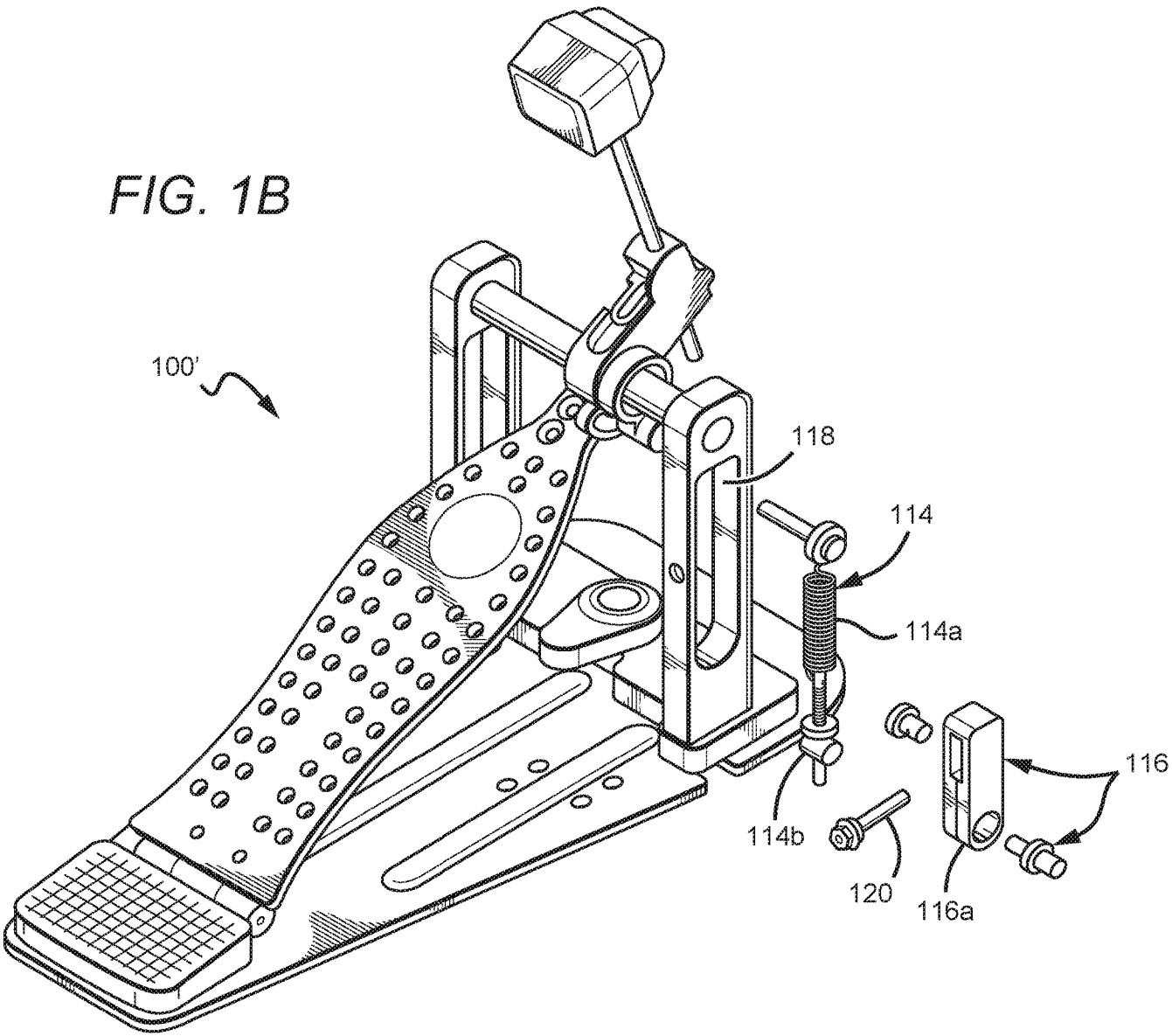

FIG. 1A shows one embodiment of a drum pedal 100 according to the present invention, with FIG. 1B showing the drum pedal 100' partially disassembled. The drum pedal 100 can include a base 102, a pedal 104, and an axle 106. The axle 106 can be mounted on one or more upright pedestals 108 (in this case two pedestals) which can be vertical or nonvertical. A lever member 110 can be rotatably attached to the axle 112. A drum beater stem 112 and beater 112*a* can be attached to the lever member 110, although in an alternate embodiment the beater stem 112 can be attached to the axle 106 without the presence of a lever member. The drum pedal 100 can include many other components, such as a clamp system for attachment to a bass drum, for example. Some appropriate clamping systems are discussed in commonly assigned U.S. patent application Ser. No. 13/663,655 to Sikra and entitled "Pivot Supports for Drum Rims", which is fully incorporated by reference herein in its entirety.

A spring assembly 114 can be used to return the drum pedal 100 to its resting position automatically after the pedal 104 has been actuated. The spring system 114 can include, for example, a spring mechanism 114*a* and a pivot 114*b*. The spring assembly 114 can be connected to a hub 120. The hub 120 can be connected to the beater stem 112, such as connected through the lever member 110. The hub 120 can connect the spring assembly 114 to other moving parts of the drum pedal 100, such as the lever member 110, beater stem 112, and pedal 104. During actuation of the pedal 104, the hub 120 can rotate in one direction about the axle 106, causing the tension in the spring mechanism 114*a* to increase. When actuation of the pedal 104 is complete, the tension in the spring mechanism 114*a* can cause the hub 120, and thus the other moving parts of the drum pedal 100, to return to their resting positions. Additionally, the amount of tension in the spring 114*a* while the drum pedal 100 is in a resting position can determine the amount of resistance a user encounters when actuating the pedal. The hub 120 and axle 106 can be rotatably linked, or can rotate independently of one another. Alternatively the axle 106 can be static and not rotate.

The pedal 100 can also include a spring tensioning assembly 116. The spring tensioning assembly can include one or more of, for example, springs, screws, bearings such as but not limited to threaded swivel bearings shown in U.S. Pat. App. Nos. 61/882,538 and 61/899,762 to Sikra, and/or many other features. The tensioning assembly 116 can be included in an aperture 118 within one of the pedestals 108, although other embodiments are possible. The tension housing 116*a* can be connected to spring assembly 114 and/or the spring mechanism 114*a*, such as through the pivot 114*b*, although other embodiments are possible. The tension housing 116*a* can be adjustable, such as vertically adjustable. Because the tension housing 116*a* can be connected to the bottom of the spring mechanism 114*a* (such as through the pivot 114*b*), moving the tension housing 116*a* up or down can change the tension provided by the spring mechanism 114*a*. For instance, moving the tension housing 116*a* up can reduce the tension in the spring mechanism 114*a*, such as by moving the pivot 114*b* up such that the mechanism 114*a* is more compact. Moving the tension housing 116*a* down can increase the tension in the spring mechanism 114*a*, such as by moving the pivot 114*b* down such that the mechanism 114*a* stretches.

The tensioning assembly 116 (and thus the spring assembly 114) can be adjusted in a number of manners. In one manner, the tension housing 116*a* can be moved by adjusting a rotatable member 122. The rotatable member 122 can be threaded, such as a screw, and/or can be adjustable using common tools in the art, such as a drum key. The rotatable member can be accessible from the outside of the pedestal 108, or can be elsewhere. Other embodiments, such as a pin method to lock the housing 116*a* into place, can also be used.

The tensioning assembly 116 can be adjustable by a user to better suit a user's needs or preferences in multiple areas. For instance, the tensioning assembly 116 can be adjusted to increase or decrease pedal resistance, and/or can be adjusted to increase or decrease the velocity with which the pedal 104 and other components return to resting position after an actuation.

FIGS. 1A and 1B show a drum pedal 100 including a spring assembly 114 between two pedestals 108, which can allow the drum pedal 100 to be more compact. However, in other embodiments a spring assembly may be outside the pedestals. This can decrease the likelihood of a drummer's foot accidentally contacting the spring assembly. FIGS. 2A and 2B show magnified side and rear views of a portion of a drum pedal 200 comprising a spring assembly 214 outside the pedestals 208. The drum pedal 200 can include a tensioning assembly 216 that can operate in a manner similar to or the same as the tensioning assembly 116 from FIGS. 1A and 1B.

Also shown in FIG. 2 are a link member 330 which can connect a pedal 304 to the remainder of the assembly. While the link member 330 and other link members shown herein are shown as rigid, thus forming "direct drive" pedals, it is understood that any type of link member can be used as is known in the art, including but not limited to chains, ropes, and/or straps. The pedal 304 and link member 330 will be discussed in detail below with regard to FIG. 3.

The spring assembly 214 can include a spring 214*a* and a pivot 214*b*, and the pedestal 208 can be shaped to define an aperture 218 similar to the aperture 118 from FIGS. 1A and 1B. The pedestal 208 can be shaped to define a second aperture 219, which can be connected to or separated from the first aperture 218 (in the case shown, the apertures are connected to one another to form one large aperture). Upon actuation of a pedal 304, the top 214*c* of the spring assembly 214 can be caused to rotate about the axle of the drum pedal 200. In this case, the top 214*c* of the spring assembly 214 would be caused to move up and to the left within the aperture portion 219*a*, as shown in FIG. 2A. Upon completion of the actuation, the spring assembly 214 will recoil such that the top 214*c* may actually pass its resting point and enter into the second portion 219*b* of the aperture 219. The presence of the second portion 219*b* of the aperture 219 can allow the drum pedal 200 to return to a resting position in a much more natural and fluid swinging motion, as opposed to reaching an abrupt halt if there were no aperture portion 219*b*, which can be undesirable.

FIGS. 3A and 3B show a pedal 300 which can include a pedal incline adjustment feature. In the embodiment shown, the pedal 304 can include a pedal attachment mechanism 332 which can be used to connect the pedal 304 to a link member 330. In the specific embodiment shown the pedal attachment mechanism 332 defines an aperture 332*a*, and the link member 330 can include a pin 334 which can act as the male piece when connecting to the attachment mechanism 332. The pin 334 can be locked into place within the aperture 332*a* using, for instance, a drum key or other screw mechanism, although many different embodiments are possible. Many other embodiments are possible, and either of the pedal 304 or the link member 330 can include male or female pieces.

The pedal incline adjustment feature can operate so as to make adjustable the angle of incline of the pedal 304. For instance, in FIG. 3A, the pin 334 is lower in the aperture 332*a*, meaning that the pedal 304 is at a lower angle of incline. In FIG. 3B, the pin 334' is locked into position higher in the aperture 332*a*, meaning that the pedal 304 is at a steeper angle of incline. The angle can be adjusted to fit a user's needs and preferences. Further, this adjustment can be made independent of other pedal features. For instance, in some prior art pedal assemblies, the pedal incline can be adjusted, but only if another feature (such as the location of the link member 330) is also altered. The pedal incline adjustment feature according to the present invention allows for much greater customization of the drum pedal assembly.

Figure 4A:
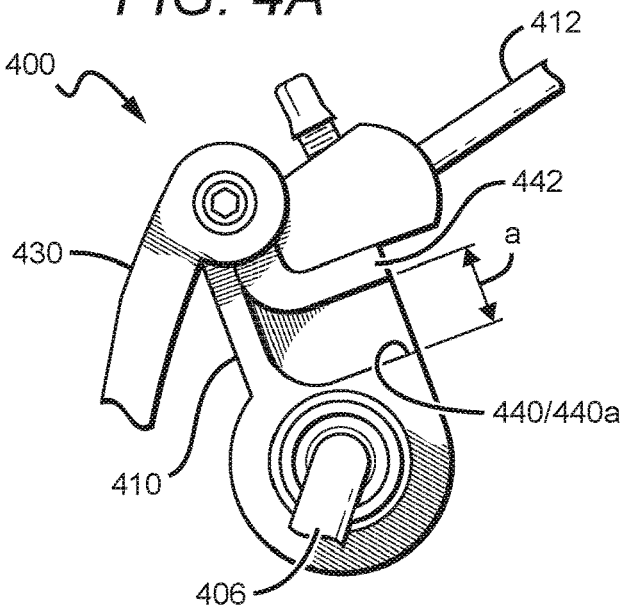
FIGS. 4A-4C are side views of a portion of another embodiment of a drum pedal assembly according to the present invention.
Figure 4B:
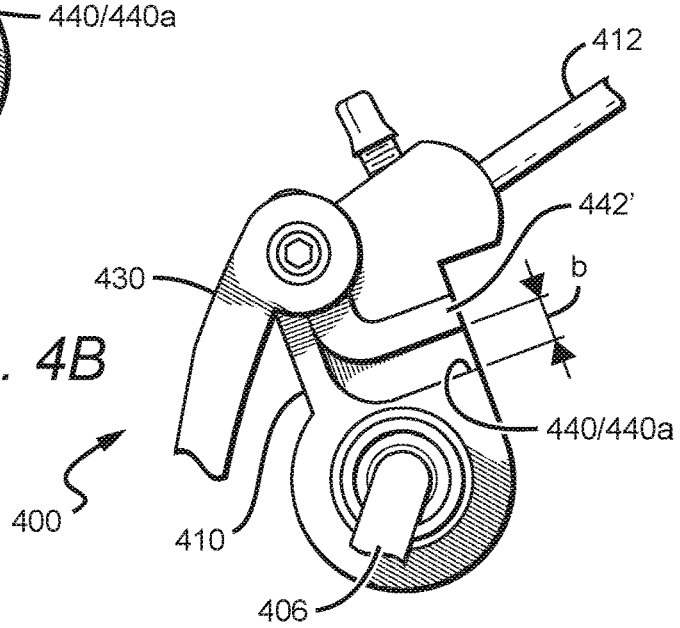
Figure 4C:
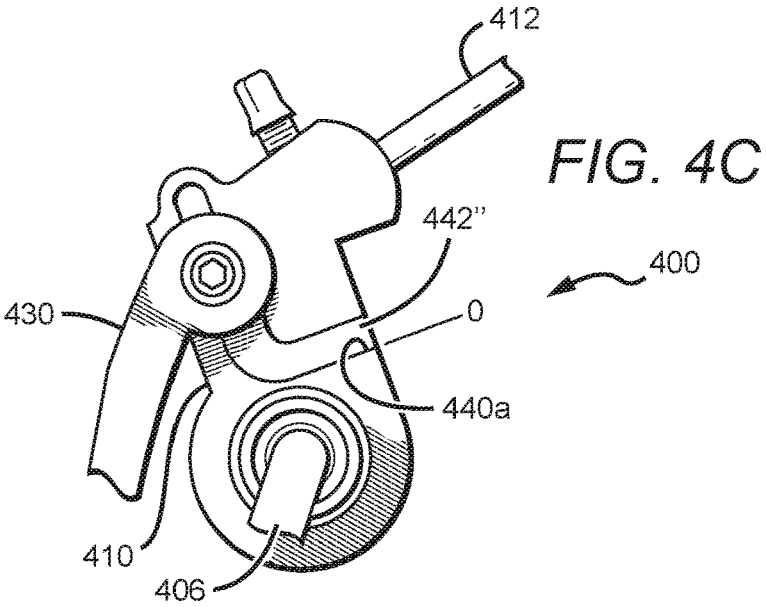

FIGS. 4A-4C show a drum pedal assembly 400 that can include a lever length adjustment feature. The assembly 400 can include a lever 410 similar to or the same as the lever 110 from FIGS. 1A and 1B, for instance. The assembly can also include an axle 406, a beater stem 412, and a link member 430. In many embodiments, the link member 430 can form a junction with the base of the beater stem 412 at or near the end of the lever 410. The length of the lever 410, or the distance between the axle 406 and the base of the beater stem 412, can have an effect on the velocity, force, path of motion, and/or other characteristics of the motion of the beater (not shown). For instance, typically a greater distance between the axle 406 and the beater stem 412, the greater the velocity and force with which the beater moves toward a drum head.

In the embodiment shown in FIGS. 4A-4C, the drum pedal assembly 400 can include a feature that allows the junction point between 1) the link member 430 and the base of the beater stem 412, and 2) the lever 410 to be adjustable. In the specific embodiment shown, the lever 410 can include a channel 440 while the link member 430 can include an adjustment member 442. When unlocked, the adjustment member 442 can slide to different locations within the channel 440, and then be locked into place, such as with a drum key or screwdriver. For instance, FIG. 4A shows an embodiment where the adjustment member 442 is within the channel 440 at a distance "a" from the inner edge 440*a* of the channel 440. In FIG. 4B, the adjustment member 442' is closer to the inner edge 440*a*, at a distance "b" from the inner edge 440*a*. In FIG. 4C, the adjustment member 442" abuts the inner edge 440*a* to minimize the distance between the base of the beater stem 412 and the axle 406.

FIGS. 5A-5C show a drum pedal assembly 500 that can include a lever angle adjustment feature. This feature can adjust the resting angle a lever 510 forms with the axle 506. In the embodiment shown, the assembly 500 can include a hub 520 which can act to connect a spring mechanism to a lever 510. In the embodiment shown, the connection between the lever 510 and the hub 520 can be made to be adjustable, with the resting orientation of the hub 520 staying relatively constant and the orientation of the lever 510 being adjusted, although other embodiments are possible. The lever 510 can include a channel and/or aperture 550, while the hub 520 can include a pin 552 or similar male part, although either of the lever 510 and hub 520 can include a male and/or female member. When unlocked, the lever 510 can be rotated about the axle 506 independent of the hub 520 and pin 552, thus adjusting the connection between the lever 510 and hub 520. For instance, in FIG. 5B the pin 552 is shown in a first position within the channel 550 such that the lever 510 is at a more downward angle. In FIG. 5C, the pin 552 is shown in a second position within the channel 550' such that the lever 510 is at a higher angle. The arrangement shown in FIG. 5B will cause a beater to impact a drum head sooner in the assembly's motion, since the lever 510, and thus the beater, begin their motion closer to the drum head, while in FIG. 5C the beater will be in a more rearward position.

Figure 6A:
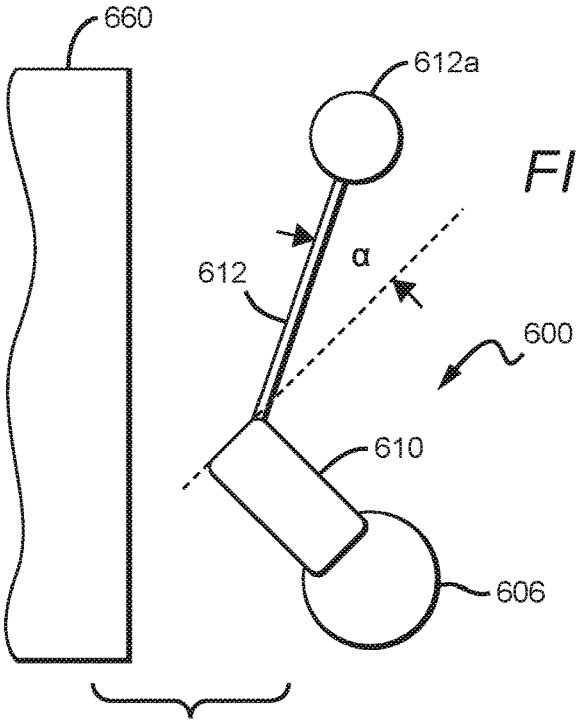
FIGS. 6A-6C are side views of a drum pedal assembly and bass drum head according to one embodiment of the present invention.
Figure 6B:
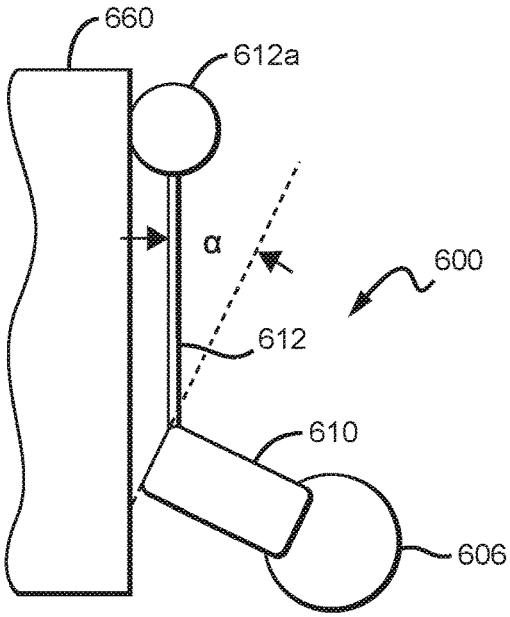
Figure 6C:
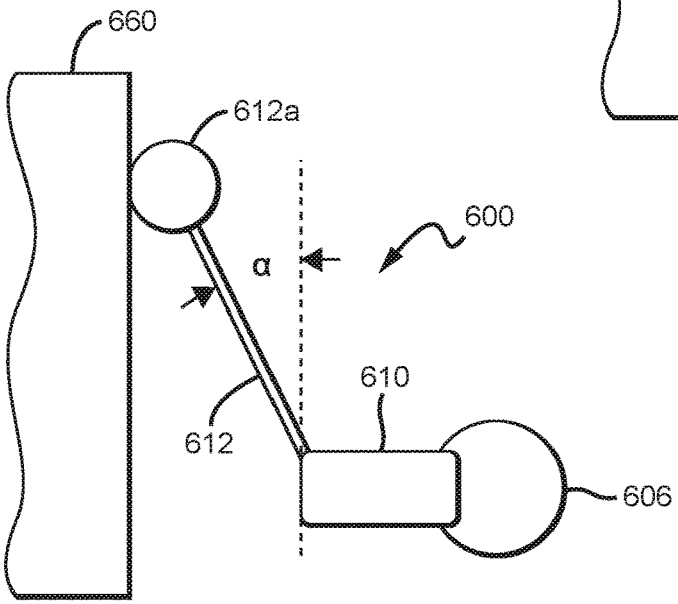

Typically, it is desirable to design a pedal assembly such that a beater impacts a drum head when the beater's motion is approximately perpendicular to the drum head and/or when the beater stem is approximately parallel to the drum head. FIGS. 6A-6C show schematics of manners in which this goal can be achieved. A drum pedal assembly 600 can include an axle 606, lever 610, beater stem 612, and beater 612*a*. The beater stem can be non-perpendicular to the lever 610, and in this embodiment is slightly forward of perpendicular by an angle $\alpha$. The forward angle can be 0° to 25°, 10° to 16°, and/or about 13°. Given such an angle, if properly arranged the lever 610 can be short of horizontal upon impact, if impact is made with the beater 612*a* travelling perpendicular to a drum head 660 (as shown in FIG. 6B). Alternatively, the lever 610 can be slightly short of horizontal, horizontal (as shown in FIG. 6C), or slightly forward of horizontal upon impact. Users have found that when a lever goes past horizontal or more than slightly past horizontal, performance can be diminished. As such, if a lever angle adjustment feature such as that shown in FIGS. 5A-5C is utilized, the feature (e.g., the channel and/or pin) can be designed such that a lever cannot pass 10° past horizontal, cannot pass 5° past horizontal, or cannot go past horizontal.

FIG. 7 shows a drum pedal assembly 700 according to the present invention which can include a flexible heel plate 770. The heel plate 770 can be attached to a base 702 and/or a hinge 772, which can itself be attached to a pedal 704. The flexible heel plate 770 can be made of, for example, metal. The heel plate 770 can be in a J-shape of a U-shape, such that in one embodiment the top 774 of the heel plate is separated from the bottom 776 of the heel plate. In the J-shape embodiment shown, the shorter end of the "J" can be attached to the base 702 while the longer end is attached to the hinge 772. This can allow the top 774 of the heel plate 770 to flex downward upon a force applied by a user of the assembly 700.

Figure 8A:
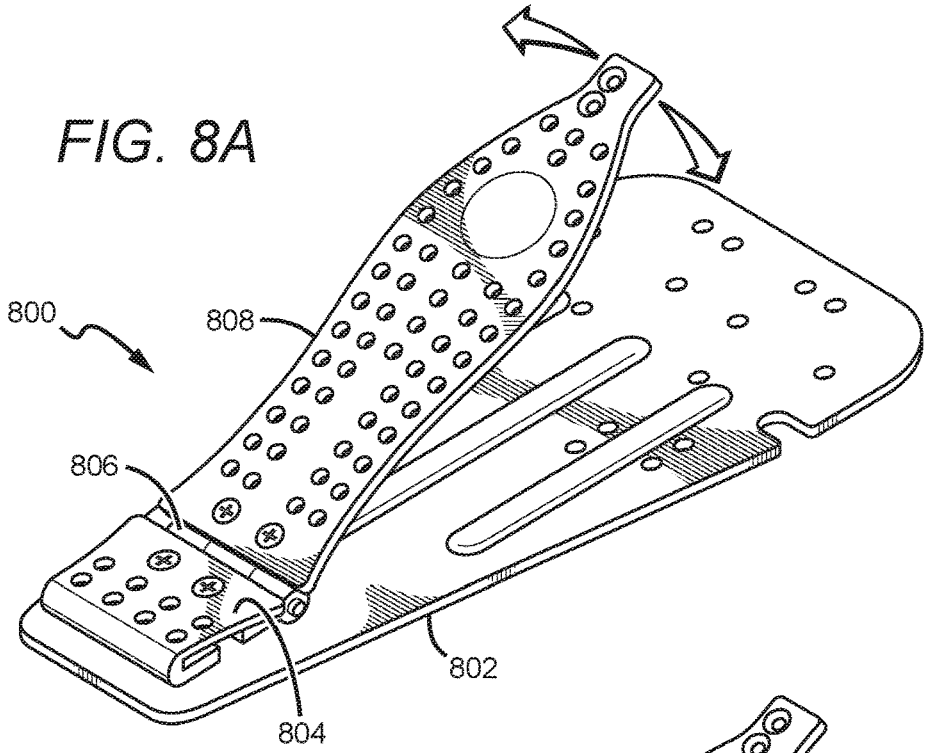

Drum pedal assemblies according to the present invention can also include interlocking features, such as interlocking features connecting a base to a heel plate, a heel plate to a hinge assembly, and/or a hinge assembly to a pedal, for example. One such drum pedal assembly 800 is shown in FIGS. 8A-8E. In many prior art pedal assemblies using conventional screw connections or other prior art connections, some elements can begin to experience undesirable movement, such as due to wear and tear. For example, the arrows in FIG. 8A show a type of undesirable lateral motion that can be experienced in many prior art assemblies. Further, undesired motion can also cause other problems such as hinge lock-up due to bending of parts. The assembly 800 can include interlocking features which can reduce or eliminate these problems.

In the specific embodiment shown, the assembly 800 includes three sets of interlocking features, although more are less are possible. Further, the assembly uses both interlocking features and screw connections, although the use of interlocking features without screw connections is possible, such as the use of interlocking features with an adhesive. Further, while each interlocking feature includes a first piece with a male part and a second piece with a female part, it us understood that different male/female combinations are possible.

Figure 8B:
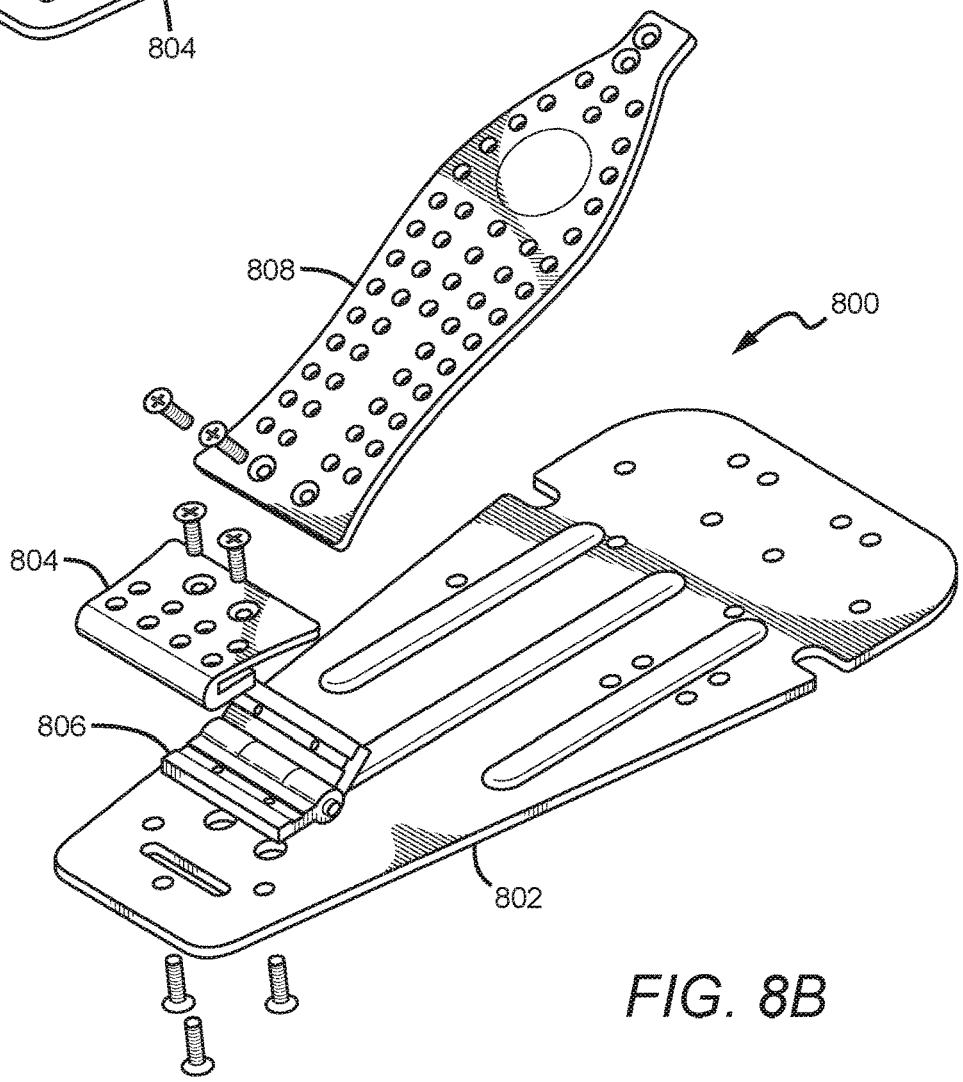

The assembly 800 can include a base 802, a heel plate 804, a hinge piece 806, and a pedal 808. The heel plate 804 can be a flexible heel plate similar to that described above with regard to FIG. 7. A first interlocking mechanism 810 is best shown in FIGS. 8B and 8D. The mechanism 810 can include parts of the base 802 and the heel plate 804. In the specific embodiment shown, the base 802 can include a slot 812, while the heel plate 804 can include a tab 814. While the slot 812 and tab 814 are shown as linear, it is understood that interlocking mechanisms according to the present invention can use many different shapes, including but not limited to zig-zag shapes, X-shapes, triangular shapes, and/or other polygon shapes, for example. Further, multiple interlocking systems can be used in conjunction with one another to connect two pieces, such as a base and heel plate.

In the interlocking system 810, the slot 812 can be a slot without a bottom surface, although in other embodiments a bottom surface may be present. Further, the slot 812 can include side surfaces to prevent lateral movement (as opposed to a slot running the entire width of the base 802). The tab 814 can fit within the slot 812 as shown in FIG. 8D.

The assembly 800 can also include an interlocking system 820, which can connect the heel plate 804 to the hinge piece 806. In this instance, the heel plate 804 can include a tab 824 while the hinge piece 806 can include a slot 822. The slot 822 is shown as including a bottom surface and running the entire width of the hinge piece 806, although in other embodiments it includes side surfaces instead of running the entire width, which can reduce or eliminate types of unwanted motion such as lateral and/or non-rotational lateral motion, for example. In the embodiment shown, fasteners 826 such as screws can be placed through both the tab 824 and the slot 822, although these screws may not be present or may be placed elsewhere.

The assembly 800 can also include interlocking system 830, which can connect the hinge piece 806 to the pedal 808. The interlocking system 830 is best shown in FIGS. 8B and 8E. The system 830 is similar in many respects to the system 820, and includes a slot 832 and tab 834 that run the entire width of their respective pieces, although embodiments including side walls are possible. As shown in FIG. 8E, the slot 832 and tab 834 have trapezoidal cross-sections, but many different cross-sections are possible, including but not limited to rectangular.

Figure 9A:
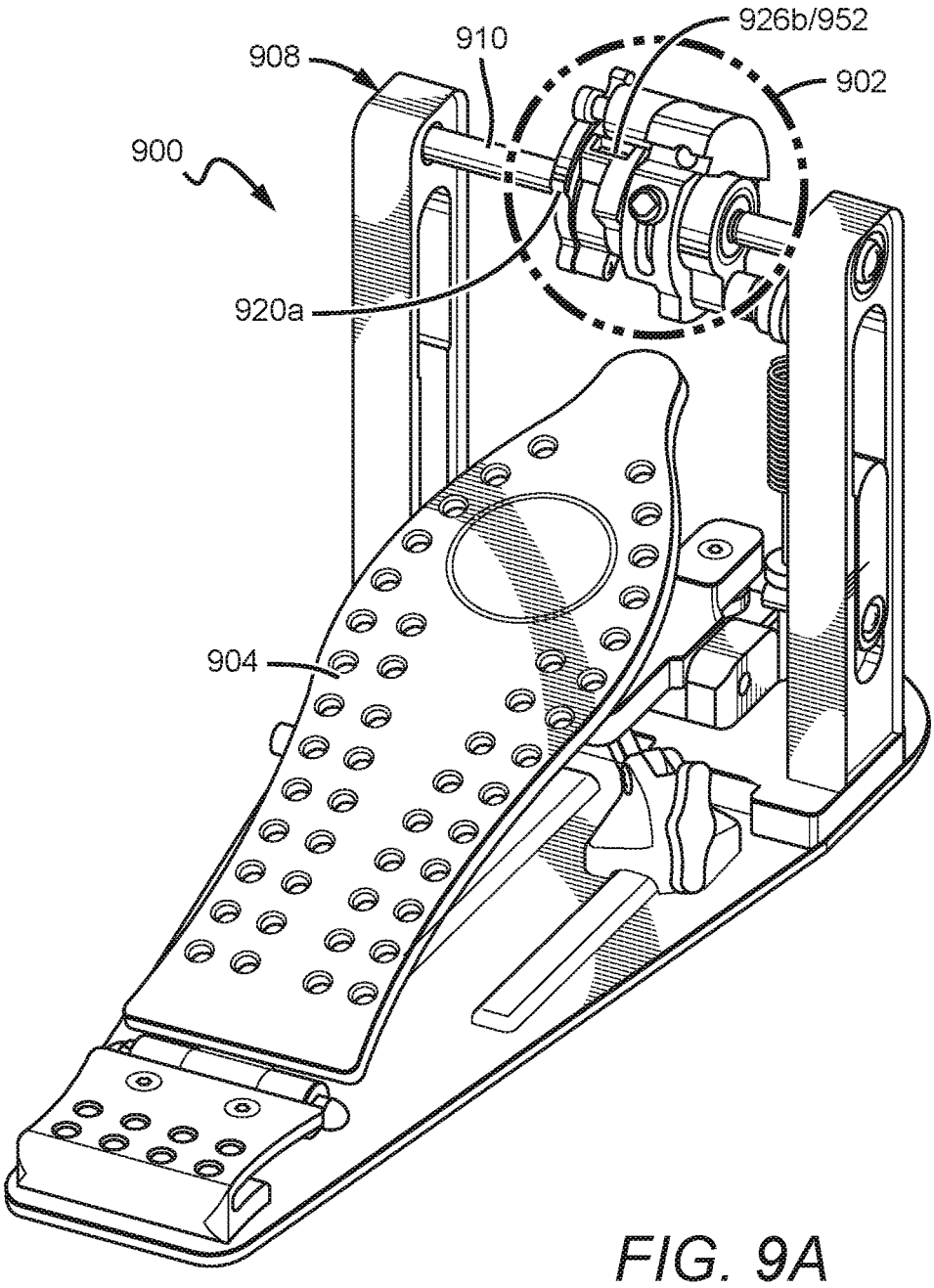
FIGS. 9A-9C are perspective views of another embodiment of a drum pedal assembly according to the present invention.
Figure 9B:
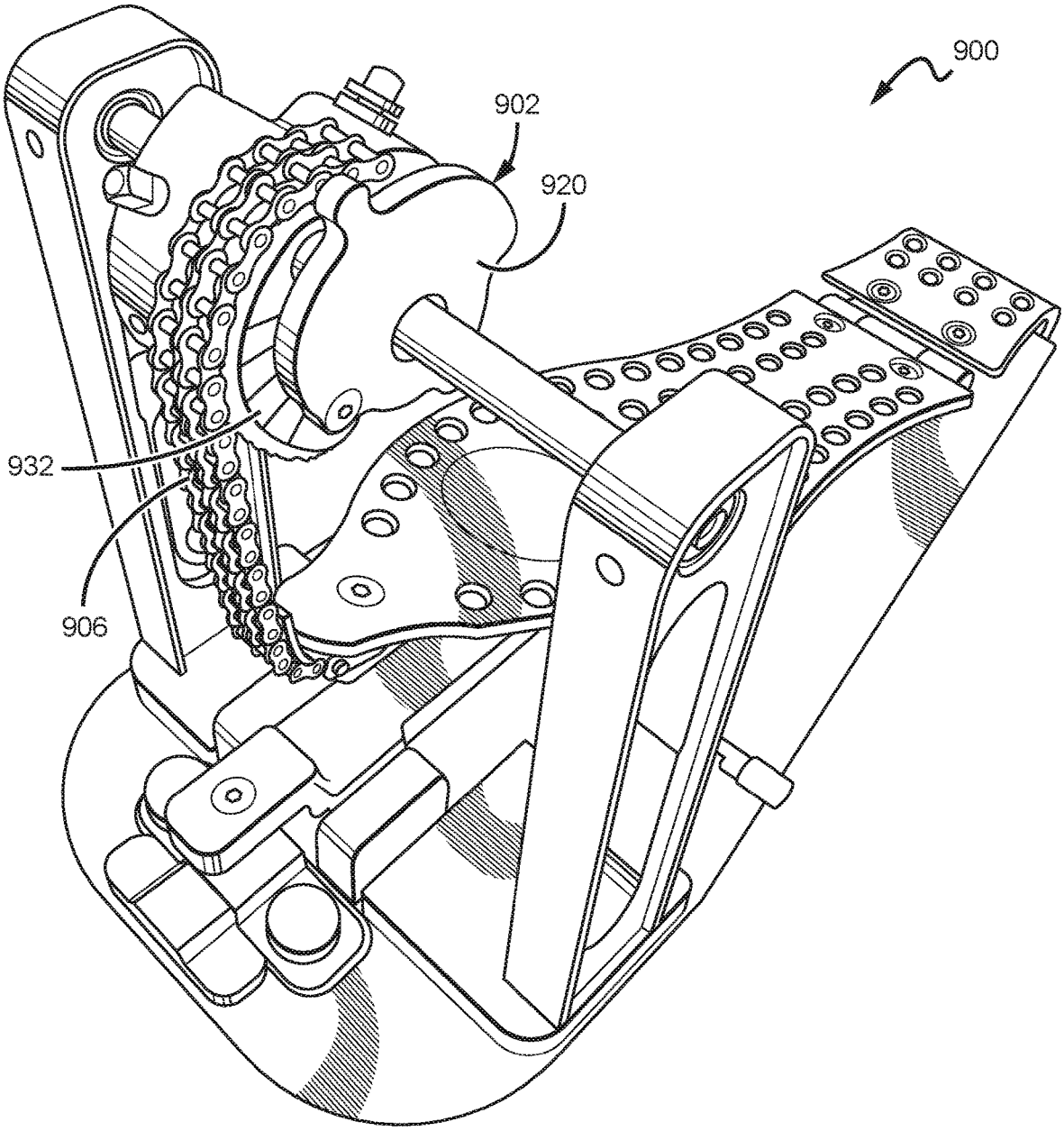
Figure 9C:
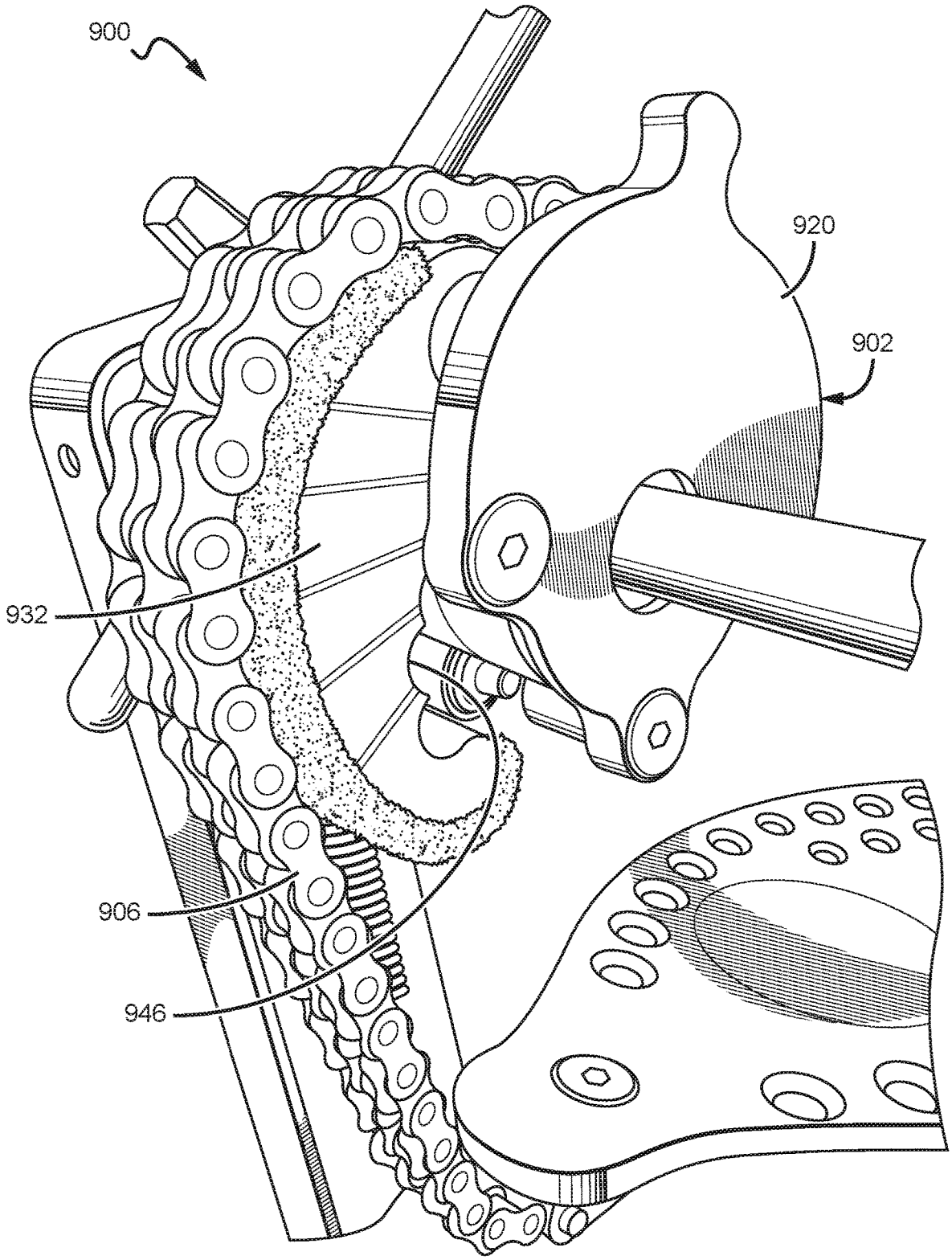
Figure 10A:
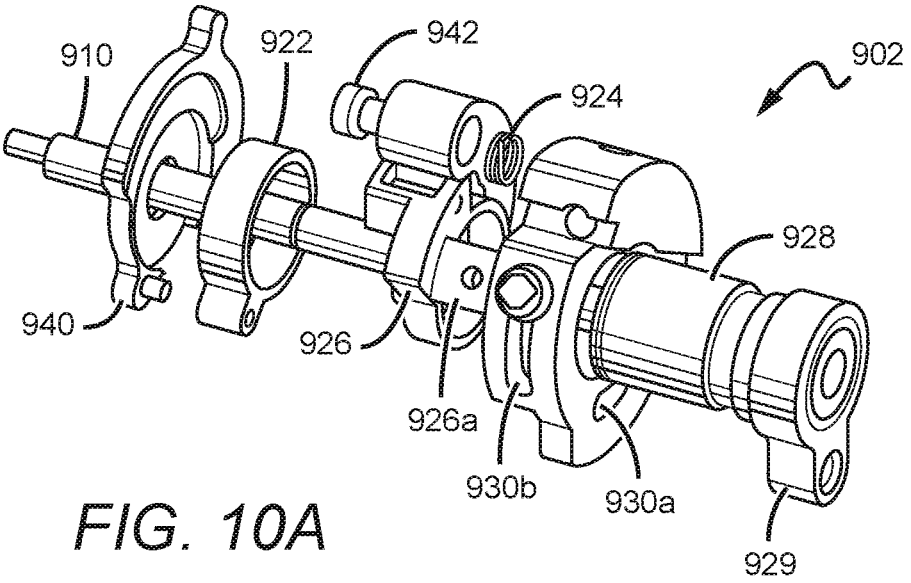
FIGS. 10A and 10B are exploded perspective views of one embodiment of a drive assembly according to the present invention.
Figure 10B:
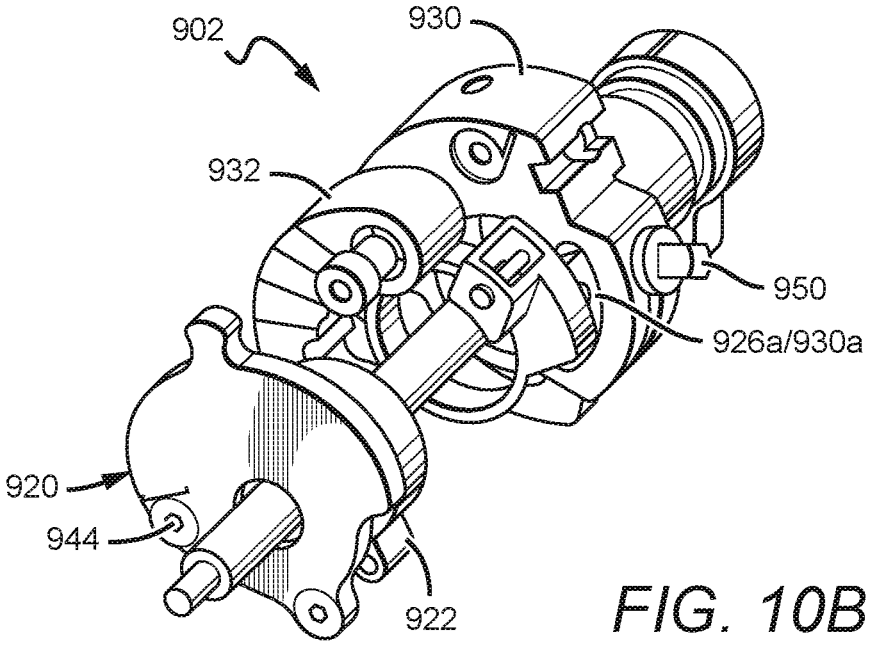

FIGS. 9A-9C are perspective views of one embodiment of a drum pedal assembly 900 according to the present invention. As shown, the assembly 900 can include a drive mechanism 902 which can be operably connected to a pedal 904, with FIGS. 10A and 10B being exploded perspective views of the drive mechanism 902, and FIGS. 11 and 12 being views of certain components of the drive mechanism 902 (all with indicator numbers for similar or equivalent components repeated). While embodiments of the present invention can include a rigid member connecting the drive mechanism and pedal such as those described above, the drum pedal assembly 900 as shown can include a non-rigid and/or flexible link member 906 connecting the drive mechanism 902 and the pedal 904. While the specific link member 906 is shown as a chain (as shown in FIGS. 9B and 9C), it is understood that many different types of link members are possible, including but not limited to chains, ropes, cords, and/or straps, among other devices. The drive mechanism 902 can be mounted on a pedestal assembly 908 and/or axle 910.

The drive mechanism 902 can include a switch cover plate 920, a cam adjustment component and/or cam adjustment ring 922, a torsion spring 924, a link member adjustment component 926, which can be a chain adjustment ring (and is referred to hereinafter as a chain adjustment ring for simplicity), a spring connection component 928, a bearing hub 929 (which in this embodiment is a portion of the spring connection component 928, but in other embodiments can be a separate component or part of another component), a beater holder 930 which can hold a drum beater or similar device (not shown), and an actuating cam 932. It is noted that while the term "chain adjustment ring" is used herein to describe the component 926, this component need not actually be connected to a chain or other device, or can be connected to any number of devices such as a rigid device used in a direct drive assembly or another non-rigid device. It is further understood that drive mechanisms according to different embodiments of the present invention can include various different combinations of the above and other features; that above features can be combined into a single feature (e.g., the switch cover plate 920 and cam adjustment ring 922 can be a single component, the chain adjustment ring 926 and actuating cam 932 can be a single component, etc); that an above feature can be split into multiple features; and that some features can be omitted.

The components of the drive mechanism 902 can include axial or other holes therethrough to enable mounting upon the axle 910. The drive mechanism 902 and each of the individual components thereof can be rotatable with the axle 910 or separately from the axle 910 (such as in a case where the axle 910 is stationary and the drive mechanism 902 rotates about the axle 910), or can be fixed with respect to the axle 910 and/or co-rotate with the axle 910. Additionally, some components may be attached to other components that are rotatable about or with the axle 910. In some embodiments the axle 910 and components of the drive mechanism 902 can rotate at different rotational speeds.

The cam adjustment ring 922 and other components of the drive mechanism 902, such as the actuating cam 932, can also be rotatable relative to one another, such as having resting positions that are rotatable relative to one another. For example, in the specific embodiment shown, the entire drive mechanism 902 can rotate upon actuation of the pedal 904. Additionally, components of the drive mechanism 902 can be rotatably adjustable, or adjustable in another manner, in relation to one another. For example, the chain adjustment ring 926, spring connection component 928, and beater holder 930 can be connected so as to rotate together, such as being rotated manually by hand and without a drum key, or otherwise, relative to the cam adjustment ring 922 and/or switch cover plate 920, so as to adjust the relative positions of the components. In the specific embodiment shown, the cam adjustment ring 922 and the switch cover plate 920 can be connected by a connector 940 so as to be rotatably adjustable, or otherwise adjustable, together, although other embodiments including embodiments omitting one or both of these elements are possible.

The actuating cam 932 can be connected to one or more other components of the drive mechanism 902. In the specific embodiment shown, the actuating cam 932 is connected to another component of the drive mechanism 902, such as the beater holder 930, via an adjustment axle 942, although other connections are possible. The adjustment axle 942 can, for example, be a post, a bolt such as a shoulder bolt, a pin, a screw, or other similar device, and many different embodiments are possible. The adjustment axle 942 can enable rotation of the actuating cam 932 about the adjustment axle 942. Further, the non-central placement of the adjustment axle 942 relative to the actuating cam 932 can cause the angle of the actuating cam 932 to be adjustable relative to the chain 906 (omitted in FIG. 9A but shown in FIGS. 9B and 9C). The adjustment axle can be connected to the beater holder 930 or other component through a torsion spring 924 and/or a torsion spring 924 can be included in the system, which can aid in the rotation of the actuating cam 932 upon a force being applied by a user, although embodiments without the torsion spring 924 are possible.

In one embodiment, the actuating cam 932 can be rotated relative to the adjustment axle 942 via movement of the cam adjustment ring 922 and/or the switch cover plate 920. The cam adjustment ring 922 and/or switch cover plate 920 can include an indexing portion 944, which can include one or more components such as posts, bolts, screws, nails, pins, rods, tubes, or other means known in the art. Further, the indexing portion can be one or more parts of one or more other components such as the switch cover plate 920 and/or cam adjustment ring 922 and/or connector 940; many different embodiments are possible. The actuating cam 932 can include grooves, teeth, or similar structures 946 (referred to herein for simplicity as "grooves") for accommodating an indexing portion such as the indexing portion 944. The rotation of the indexing portion 944 into and out of a groove such as one of the groves 946 can, in some embodiments, be achieved by hand, without tools such as a drum key. Further, the indexing portion and grooves can be designed such that the indexing portion falls into the next groove once it has been moved from a first groove by a certain distance, such that the indexing portion is unlikely to stop at a point between grooves. The indexing portion 944 and/or grooves 946 can be shaped such that a certain level of force is required to move the indexing portion 944 to a different groove 946, and shaped such that movement of the indexing portion 944 to a different groove 946 does not take place unintentionally (such as solely via the inherent force upon the drive mechanism 902 during operation of the pedal assembly 900).

The actuating cam 932 can be shaped such that rotation of the actuating cam 932 about the adjustment axle 942 alters the path that the chain takes from the actuating cam 932 to the pedal 904. For example, rotation of the actuating cam 932 forward (away from the axle 910, such that the indexing portion 944 moves toward the top groove 946) can cause the radius about which the chain 906 is directed to increase, such that the chain 906 takes a less direct path to the pedal 904, which can cause a faster pedal/footboard rebound. Rotation of the actuating cam 932 backward (toward the axle 910, such that the indexing portion 944 moves toward the bottom groove 946) can cause this radius to decrease such that the chain 906 takes a more direct path to the pedal 904, which can cause a slower footboard rebound and/or less footboard rebound comparatively. The user can thus adjust the drive mechanism 902 and/or components thereof to achieve a desired feel during pedal actuation and/or as the pedal returns to its resting position after actuation. In some embodiments such as that shown, this adjustment can be made by hand and/or without the assistance of a drum key or other tools. Many different embodiments are possible, and it is understood that that other embodiments are drive mechanisms according to the present invention can rotate in different manners than that specifically described above.

In some embodiments of the present disclosure, the angle of the pedal 904 and/or the extent to which the chain 906 wraps around the drive mechanism 902 can also be adjustable, either together or separately. For example, the resting position of the chain adjustment ring 926 can be adjusted via rotation relative to the axle 910 and relative to the other portions of the drive mechanism 902 and/or to the beater holder 930. In one embodiment, the chain adjustment ring 926 can include a chain adjustment feature 926*a*, which can be integral or not integral with the chain adjustment ring 926. For instance, in one embodiment the chain adjustment feature 926*a* is a protrusion from the remainder of the chain adjustment ring 926. The chain adjustment feature 926*a* can fit within a first channel 930*a* or other aperture or other corresponding component of the beater holder 930 (or other component). It is noted that in some embodiments the chain adjustment feature may be the negative/female component and the beater holder component may be the positive/male component, and in some other embodiments, non-male/female connectors are possible. A connector 950 such as a drum key screw can then be applied through a second channel 930*b* of the beater holder 930 so as to lock the chain adjustment feature 926*a* (and thus, in this embodiment, the chain adjustment ring 926) into place relative to the beater holder 930. Loosening of the connector 950 can enable rotational adjustment of the chain adjustment ring 926 due to the presence of the adjustment feature 926*a* within the first channel 930*a*. While this adjustment may not change the operable chain length, it can change the position of the point where the chain meets the chain adjustment ring 926, such as moving it backward (which can also cause a raising of the pedal/footboard and an increase in pedal/footboard angle to the ground) or moving it forward (which can also cause a lowering of the pedal/footboard and a decrease in pedal/footboard angle to the ground). This can be due to the fact that with regard to this adjustment feature the positioning of the beater holder 930 can be held approximately constant, since it is more directly attached to the pedal assembly spring which will hold the beater holder 930 in position (unless certain other adjustments are made, which may cause the resting position of the beater holder 930 to change).

Adjustment of the resting position of the beater holder 930 can be achieved by adjusting the position of the beater holder 930 relative to the spring connection component 928. For example, the beater holder 930 can be shaped to define a positioning channel 930*a* or other similar component and the spring connection component 928 can include a connector which has a position that is adjustable within the positioning channel 930*a*. It is understood that while in the specific embodiment shown the beater holder includes the female component (channel 930*a*) and the spring connection component 928 includes the male component, the opposite is possible, and many different types of adjustable connections are possible.

The chain adjustment ring 926 can include an aperture for placement of, for example, a post or pin 952 or other connector as known in the art and/or previously described (referred to herein for simplicity as a "pin," although other connectors are possible). The chain 906 can include a corresponding aperture. An end or other portion of the chain 906 can be placed within an aperture 926*b* within the chain adjustment ring 926, and the pin 952 placed partially or fully through the apertures of both the chain 906 and chain adjustment ring 926 in order to attach the chain 906 to the drive mechanism 902. The aperture 926*b* of the chain adjustment ring 926 can be shaped to accommodate portions of the chain such that it need not necessarily be the end of the chain 906 that is connected to the chain adjustment ring 926, but instead an intermediate piece. Thus, the connection point between the chain 906 and the chain adjustment ring 926 can be moved to different points along the chain 906. This can allow a user to adjust the operable chain length, which can also cause an alteration of pedal/footboard height and angle (shorter chain length results in a higher pedal/footboard and higher pedal/footboard angle, and longer chain length results in a lower pedal/footboard and lower pedal/footboard angle).

The pin 952 can be secured, for example, by a portion 920*a* of the switch cover plate, which can prevent the pin 952 from being removed and/or falling out of the chain adjustment ring aperture 926*b*. It is understood that components other than or in addition to the portion 920*a* can hold the pin 952 in place. The pin 952 can be exposed for removal, for example, when one or both of the actuating cam 932 and the chain adjustment ring 926 are in a certain position (which can be achieved using the adjustment mechanisms and methods described above). For example, in one embodiment, both of the adjustments must be maximized or minimized (e.g., the indexing portion 944 in the uppermost or lowermost groove 946, and the connector 950 at or near an end of the channel 930*b*) to expose the pin 952 for removal. Many different embodiments are possible. A similar system can be utilized to connect another end or portion of the chain 906 to the pedal 904, such as to the bottom of the pedal 904.

Figure 13:
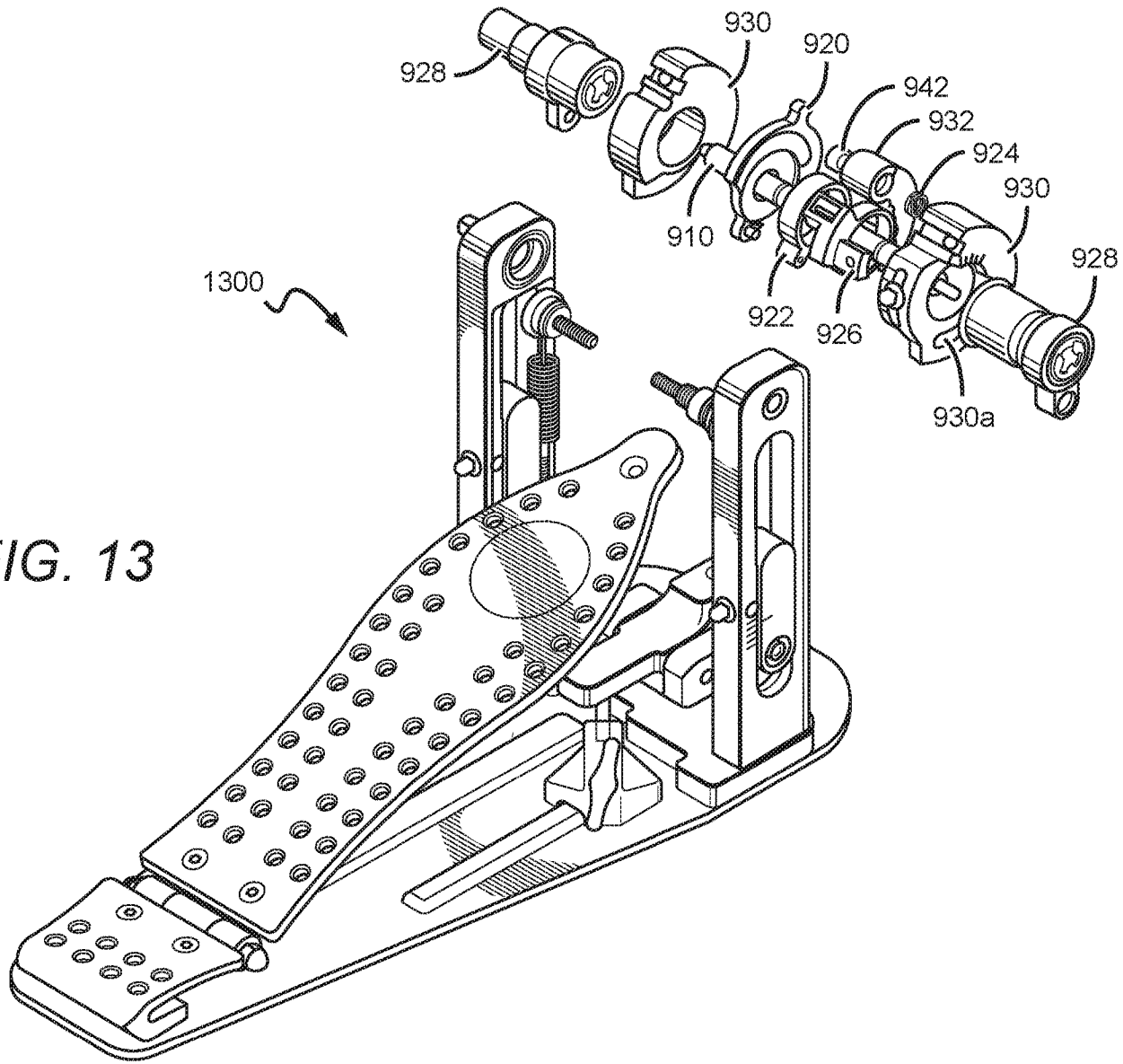
FIG. 13 is an exploded perspective view of another embodiment of a drum pedal assembly according to the present invention.
Figure 14:
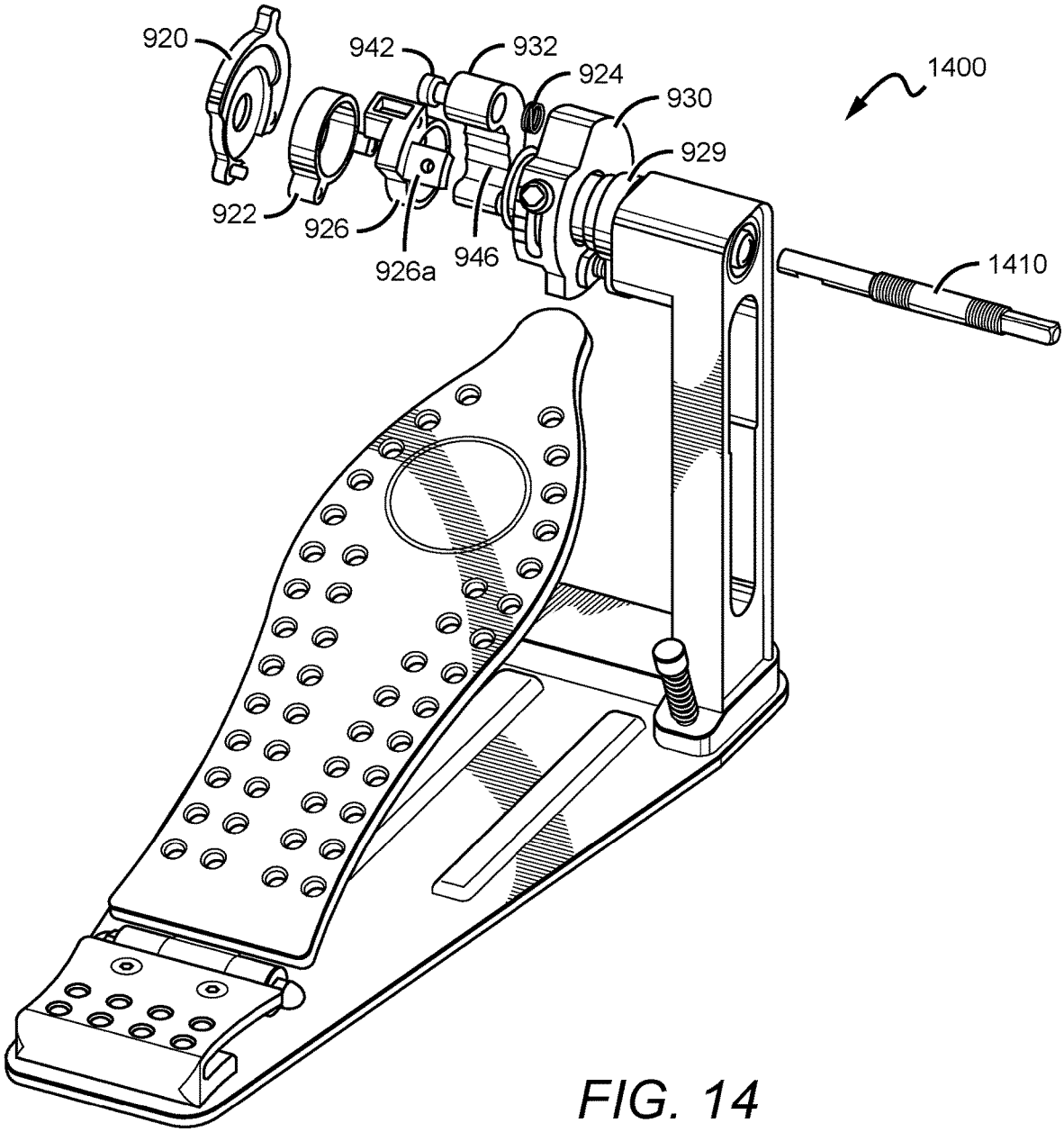
FIG. 14 is an exploded perspective view of another embodiment of a drum pedal assembly according to the present invention.

Components and features described with regard to the above embodiments, such as components and features described with regard to the drum pedal assembly 900, can also be utilized with double pedal arrangements. FIG. 13 is a perspective exploded view of a pedal assembly 1300 according to one embodiment of the present invention, which is configured for connection to a second pedal (with indicator numbers for similar or equivalent components repeated). FIG. 14 is a perspective exploded view of an auxiliary pedal assembly 1400 according to one embodiment of the present invention, which is configured for connection to a second pedal (with indicator numbers for similar or equivalent components repeated). The auxiliary pedal assembly 1400 can include an axle 1410. The auxiliary pedal assembly 1400 can be connected to the pedal assembly 1300.

It is understood that any of the embodiments shown or described with regard to FIGS. 9-14 can include components from those embodiments shown described with regard to FIGS. 1-8, and any of the embodiments shown or described with regard to FIGS. 1-8 can include components from those embodiments shown or described above with regard to FIGS. 9-14.

Although the present invention has been described in detail with reference to certain preferred configurations thereof, other versions are possible. Therefore, the spirit and scope of the invention should not be limited to the versions described above.

I claim:

1. A drum beating device, comprising:

an axle;

a drive mechanism on said axle, said drive mechanism comprising a beater holder, a link member adjustment component, an actuating cam, and a cam adjustment component;

a pedal; and a link member operably connecting said pedal to said link member adjustment component, said link member passing over said actuating cam to attach to said link member adjustment component, said actuating cam between said link member and said link member adjustment component;

wherein a resting position of said link member adjustment component is adjustable relative to a resting position of said beater holder;

wherein a resting position of said actuating cam is adjustable relative to the resting position of said link member adjustment component so as to alter a path of said link member from said pedal to said link member adjustment component;

wherein said cam adjustment component comprises an indexing portion, said actuating cam defining a plurality of grooves, a resting position of said cam adjustment component configured to rotatably adjust so as to move said indexing portion between said grooves, wherein the resting position of said actuating cam is at least partially dependent upon which of said plurality of grooves is accommodating said indexing portion; and wherein said cam adjustment component comprises a cam adjustment ring, said cam adjustment ring between said actuating cam and said axle.

2. The drum beating device of claim 1, wherein one of said link member adjustment component and said beater holder comprises an adjustment feature and the other of said link member adjustment component and said beater holder is shaped to define a channel, at least a portion of said adjustment feature within said channel and having a resting position adjustable within said channel.

3. The drum beating device of claim 1, wherein said link member is flexible.

4. The drum beating device of claim 1, wherein said link member is a chain.

5. The drum beating device of claim 1, wherein the resting position of said link member adjustment component is rotatably adjustable relative to the resting position of said beater holder.

6. The drum beating device of claim 1, wherein forward rotational adjustment of the resting position of said link member adjustment component causes lowering of a resting angle of said pedal, and rearward rotational adjustment of the resting position of said link member adjustment component causes raising of the resting angle of said pedal.

7. The drum beating device of claim 1, wherein said link member adjustment component is a ring.

8. The drum beating device of claim 1, wherein said actuating cam is connected to said beater holder by an adjustment axle.

9. The drum beating device of claim 8, wherein the resting position of said actuating cam is rotatably adjustable about said adjustment axle so as to adjust the resting position of said actuating cam relative to the resting position of said link member adjustment component.

10. The drum beating device of claim 8, wherein said adjustment axle is non-central to said actuating cam.

11. The drum beating device of claim 8, wherein an axis of said adjustment axle is parallel to but not coincident with an axis of said axle.

12. A drum beating device, comprising:

a beater holder shaped to define an axial hole;

an adjustment ring shaped to define an axial hole;

an axle through said beater holder axial hole and said adjustment ring axial hole;

an actuating cam connected to said beater holder by an adjustment axle, said adjustment axle parallel to said axle;

a pedal; and a link member connecting said pedal to said adjustment ring;

wherein said adjustment ring and said beater holder are connected so as to rotate together when said pedal is actuated; and wherein said actuating cam has a resting position that is rotatably adjustable about said adjustment axle so as to alter a path of said link member from said pedal to said adjustment ring.

13. The drum beating device of claim 12, wherein said link member is a chain and said adjustment ring is a chain adjustment ring.

14. The drum beating device of claim 12, wherein said adjustment axle is non-central to said actuating cam.

15. The drum beating device of claim 12, wherein an axis of said adjustment axle is parallel to but not coincident with an axis of said axle.

16. A drum beating device, comprising:

an axle;

a drive mechanism on said axle, said drive mechanism comprising a beater holder, a link member adjustment component, and an actuating cam, said axle through an axial hole of said beater holder and an axial hole of said link member adjustment component, said actuating cam connected to said beater holder by an adjustment axle, said link member adjustment component between said actuating cam and said axle;

a pedal; and a link member between said pedal and said link member adjustment component, said link member passing over said actuating cam and connecting to said link member adjustment component;

wherein a resting position of said link member adjustment component is rotatably adjustable relative to a resting position of said beater holder;

wherein one of said link member adjustment component and said beater holder comprises a main body and a protrusion therefrom, and the other of said link member adjustment component and said beater holder is shaped to define a first channel, at least a portion of said protrusion within said first channel and having a resting position adjustable within said first channel so as to adjust the resting position of said link member adjustment component relative to the resting position of said beater holder;

wherein the one of said link member adjustment component and said beater holder that is shaped to define said first channel is shaped to define a second channel, said drive mechanism further comprising a connector configured to pass through said second channel and secure said protrusion within said first channel when said connector is tightened;

wherein a resting position of said actuating cam is rotatably adjustable about said adjustment axle so as to adjust the resting position of said actuating cam relative to the resting position of said link member adjustment component and so as to alter a path of said link member from said pedal to said link member adjustment component; and wherein an axis of said adjustment axle is parallel to but not coincident with an axis of said axle.

17. The drum beating device of claim 16, wherein said beater holder is shaped to define said first channel and said second channel, and said link member adjustment component comprises said main body and said protrusion.

18. The drum beating device of claim 16, wherein said first channel is less than 360° around said axle.

19. The drum beating device of claim 16, wherein said first channel is shaped to define a portion of a circle separated from said axle by a first distance.

20. The drum beating device of claim 16, wherein said protrusion is integral with said main body.

21. The drum beating device of claim 16, wherein the resting position of said protrusion is adjustable within said first channel over a continuous range of positions.

22. The drum beating device of claim 1, wherein said cam adjustment component comprises a plate, said cam adjustment ring between said plate and said link member adjustment component.

23. The drum beating device of claim 1, wherein said cam adjustment component comprises a plate.

24. The drum beating device of claim 12, wherein said adjustment ring has a resting position that is rotatably adjustable relative to said beater holder.

25. The drum beating device of claim 12, wherein said actuating cam is between said link member and said adjustment ring.

26. The drum beating device of claim 12, wherein said link member passes over said actuating cam and attaches to said adjustment ring.

27. The drum beating device of claim 26, wherein an operable length of said link member is adjustable by adjusting which portion of said link member attaches to said adjustment ring.

28. The drum beating device of claim 27, wherein said link member is flexible.

29. The drum beating device of claim 28, wherein said link member is a chain.

30. The drum beating device of claim 12, wherein said link member is flexible.

31. The drum beating device of claim 12, wherein said pedal is on a footboard, and further comprising a pedestal on said footboard;

wherein said axle is attached to said pedestal.

32. The drum beating device of claim 31, wherein said pedestal is a first pedestal, and further comprising a second pedestal on said footboard, wherein said axle is also attached to said second pedestal.

33. The drum beating device of claim 1, wherein said cam adjustment ring is shaped to define an axial hole, said axle through said axial hole.

34. A drum beating device, comprising:

an axle;

a drive mechanism on said axle, said drive mechanism comprising a beater holder, a link member adjustment component, and an actuating cam;

a pedal; and a link member operably connecting said pedal to said link member adjustment component, said link member passing over said actuating cam to attach to said link member adjustment component, said actuating cam between said link member and said link member adjustment component;

wherein a resting position of said actuating cam is adjustable relative to a resting position of said link member adjustment component so as to alter a path of said link member from said pedal to said link member adjustment component wherein said actuating cam is connected to said beater holder by an adjustment axle; and wherein an axis of said adjustment axle is parallel to but not coincident with an axis of said axle.

35. The drum beating device of claim 34, wherein the resting position of said actuating cam is rotatably adjustable about said adjustment axle so as to adjust the resting position of said actuating cam relative to the resting position of said link member adjustment component.

36. The drum beating device of claim 34, wherein said adjustment axle is non-central to said actuating cam.

37. The drum beating device of claim 34, wherein the resting position of said link member adjustment component is adjustable relative to a resting position of said beater holder.

38. The drum beating device of claim 34, wherein the resting position of said actuating cam is adjustable about said adjustment axle.

39. The drum beating device of claim 38, wherein said adjustment axle is through a torsion spring.

* * * * *